US008309913B2

(12) United States Patent
Wang et al.

(10) Patent No.: US 8,309,913 B2
(45) Date of Patent: Nov. 13, 2012

(54) ANGLED DUAL-POLARITY MASS SPECTROMETER

(75) Inventors: Yi-Sheng Wang, Taipei (TW); Chung-Hsuan Chen, Knoxville, TN (US)

(73) Assignee: Academia Sinica, Taipei (TW)

( * ) Notice: Subject to any disclaimer, the term of this patent is extended or adjusted under 35 U.S.C. 154(b) by 63 days.

(21) Appl. No.: 12/689,506

(22) Filed: Jan. 19, 2010

(65) Prior Publication Data

US 2010/0181474 A1 Jul. 22, 2010

Related U.S. Application Data

(63) Continuation-in-part of application No. 11/542,568, filed on Oct. 3, 2006, now Pat. No. 7,649,170.

(51) Int. Cl.
*H01J 49/10* (2006.01)

(52) U.S. Cl. ..... 250/281; 250/282; 250/288

(58) Field of Classification Search ..... 250/281–300
See application file for complete search history.

(56) References Cited

U.S. PATENT DOCUMENTS

| | | | | |
|---|---|---|---|---|
| 2,422,264 | A * | 6/1947 | Seaman | 250/281 |
| 4,267,448 | A * | 5/1981 | Feser et al. | 250/281 |
| 5,135,870 | A | 8/1992 | Williams et al. | 435/173 |
| 5,171,989 | A | 12/1992 | Williams et al. | 250/288 |
| 5,998,215 | A | 12/1999 | Prather et al. | 436/173 |
| 6,091,068 | A * | 7/2000 | Parfitt et al. | 250/292 |
| 6,627,883 | B2 | 9/2003 | Wang et al. | 250/292 |
| 6,707,037 | B2 * | 3/2004 | Whitehouse | 250/288 |
| 6,815,671 | B2 | 11/2004 | Johnston et al. | 250/287 |
| 6,888,130 | B1 | 5/2005 | Gonin | 250/287 |
| 7,223,969 | B2 | 5/2007 | Schultz et al. | 250/290 |
| 7,259,369 | B2 | 8/2007 | Scott et al. | 250/287 |
| 7,649,170 | B2 * | 1/2010 | Wang et al. | 250/281 |

OTHER PUBLICATIONS

Gard et al., "Real-Time Analysis of Individual Atmospheric Aerosol Particles: Design and Performance of a Portable ATOFMS", Anal. Chem., 69, pp. 4083-4091, 1997.

Guilhaus, M., "Spontaneous and Deflected Drift-Trajectories in Orthogonal Acceleration Time-of-Flight Mass Spectrometry," Journal of American Society for Mass Spectrometry, 5, pp. 588-595, 1994.

Hinz et al., "Simultaneous Detection of Positive and Negative Ions From Single Airborne Particles by Real-time Laser Mass Spectrometry", Aerosol Science and Technology, 24:233-242, 1996.

Russell et al., "Achieving High Detection Sensitivity (14 zmol) of Biomolecular Ions in Bioaerosol Mass Spectrometry", Anal. Chem., 77, pp. 4734-4741, 2005.

Wuijckhuijse et al., "Matrix-assisted laser desorption/ionisation aerosol time-of-flight mass spectrometry for the analysis of bioaerosols: development of a fast detector for airborne biological pathogens", Journal of Aerosol Science, 36, pp. 677-687, 2005, 2005.

(Continued)

*Primary Examiner* — Jack Berman
(74) *Attorney, Agent, or Firm* — Fish & Richardson P.C.

(57) ABSTRACT

An angled dual-polarity mass spectrometer includes a dual-polarity ion generator, a first mass analyzer, and a second mass analyzer. The dual-polarity ion generator includes an ion source to generate positive ions and negative ions from a sample, and electrodes to generate electric fields for guiding the negative ions into a beam of negative ions and guiding the positive ions into a beam of positive ions. The first mass analyzer can analyze the negative ions, and the second mass analyzer can analyze the positive ions. The central axes of the first and the second mass analyzers are at an angle between 0 to 179 degrees.

24 Claims, 21 Drawing Sheets

OTHER PUBLICATIONS

"Notification of Transmittal of The International Search Report and The Written Opinion of the International Searching Authority, or the Declaration", International Application No. PCT/US2007/080284, 13 pages, dated Oct. 23, 2008.

"Notification of Transmittal of The International Seach Report and The Written Opinion of the International Searching Authority, or the Declaration", International Application No. PCT/US2011/021595, 11 pages, dated Mar. 16, 2011.

* cited by examiner

ANGLED DUAL-POLARITY MASS SPECTROMETER

RELATED APPLICATION

This application is a continuation-in-part of, and claims priority to, U.S. Ser. No. 11/542,568, filed on Oct. 3, 2006, and issued on Jan. 19, 2010, as U.S. Pat. No. 7,649,170, the contents of which are incorporated herein by reference.

BACKGROUND OF THE INVENTION

The description relates to angled dual-polarity mass spectrometers.

Mass spectrometers can be used to determine the identities and quantities of components that make up a solid, gas, or liquid sample. A mass spectrometer may use the mass (m) to charge (z) ratios of ions to separate and analyze the ions. In one example, a time-of-flight mass spectrometer includes an acceleration region having electrodes that generate an electric field for accelerating either the positive ions (cations) or negative ions (anions) and direct them toward one end of a flight tube. Heavier ions travel at a slower speed while smaller ions travel at a higher speed in the flight tube. The ions are detected by a sensor at the other end of the flight tube. The m/z ratios can be derived based on the amount of time that it takes for the ions to travel the length of the flight tube.

In general, both positively and negatively charged particles are produced from a sample during an ionization process. Single-polarity mass spectrometers can be configured to measure either positive or negative ions, but not both, at a given time. Such measurements may not be able to capture all of the information of the sample, and may lose some information on the types and quantities of ions. Dual-polarity mass spectrometers can measure both positive and negative ions at the same time. An example of a dual-polarity mass spectrometer is an aerosol time-of-flight mass spectrometer that determines the size and chemical composition of aerosol particles by accelerating the particles through a nozzle and skimmers to produce a well-defined beam of particles. The particles are maintained electrically neutral until they reach an ionization location, upon which the neutral particles are irradiated by a laser and produce positively and negatively charged small molecules. The charged molecules are analyzed by a bipolar, time-of-flight mass spectrometer having two flight tubes, each for analyzing the positive and negative ions, respectively.

SUMMARY

The present invention relates to a dual-polarity mass spectrometer for simultaneous determination of the mass spectra of negative ions and positive ions generated from a sample. The sample can be positioned on a surface of an ion source electrode or propagated into an ion source region. The ion source electrode and extraction electrodes generate electric fields such that the positive and negative ions, after being generated from the sample, are extracted away from the ion source region and directed toward acceleration stages that accelerate the negative and positive ions toward a negative mass spectrometer and a positive ion mass spectrometer, respectively.

The dual-polarity mass spectrometer can be used to analyze sample materials that include, for example, salts, alloys, semiconductor materials, semiconductor chips, particles, chemicals, biomolecules, physiological fluids, biological tissues, skins, metals, and plasma. The sample materials can be stationary or mobile prior to being ionized. The dual-polarity mass spectrometer can analyze the surface properties of a sample material by extracting just the surface layers of the sample material to produce the positive and negative ions. The dual-polarity mass spectrometer can also analyze deeper portions of the sample material beneath the surface layers. The sample material used in the dual-polarity mass spectrometer may have dimensions of several millimeters, such as biological tissues, or even larger. The sample material may also be atoms, molecules, small particles of micron size or nanoparticles.

In one aspect, in general, an angled dual-polarity mass spectrometer includes a dual-polarity ion generator, a first mass analyzer, and a second mass analyzer. The dual-polarity ion generator includes an ion source to generate positive ions and negative ions from a sample, and electrodes to generate electric fields for guiding the negative ions into a beam of negative ions and guiding the positive ions into a beam of positive ions. The first mass analyzer can analyze the negative ions, and the second mass analyzer can analyze the positive ions, the central axes of the first and the second mass analyzers being at an angle between 0 to 179 degrees.

Implementations of the mass spectrometer may include one or more of the following features. The first mass analyzer can include a first flight tube to receive the beam of negative ions, and a first ion detector to detect negative ions that travel in the first flight tube. The second mass analyzer can include a second flight tube to receive the beam of positive ions, the second flight tube being at an angle between 0 to 179 degrees relative to the first flight tube, and a second ion detector to detect positive ions that travel in the second flight tube. An axis of the second flight tube can be at an angle between 0 to 179 degrees relative to an axis of the first flight tube. In some examples, an axis of the second flight tube can be at an angle between 20-60 degrees relative to an axis of the first flight tube.

The first ion detector can include a scintillation detector, a microchannel plate detector, an electron multiplier, or an electric current detector. The electrodes can include a negative ion extraction electrode and a positive ion extraction electrode, the negative ion extraction electrode having a voltage that is higher than that of a sample plate on which the sample is placed, the positive ion extraction electrode having a voltage that is lower than that of the sample plate. The electrodes can include a negative ion acceleration electrode and a positive ion acceleration electrode, the negative ion acceleration electrode having a voltage that is higher than that of the sample plate, the positive ion acceleration electrode having a voltage that is lower than that of the sample plate, each of the negative and positive ion acceleration electrodes including a grid having openings to allow ions to pass. Each of the negative and positive ion extraction electrodes can include a grid having openings to allow ions to pass. The electrodes can be configured to generate an electric field that causes the beam of negative ions to travel, on average, along a first central axis of the first mass analyzer and the beam of positive ions to travel, on average, along a second central axis of the second mass analyzer, the second average axis being at an angle in a range of 0 to 179 degrees relative to the first central axis. In some examples, the second axis can be at an angle between 20-60 degrees relative to the first axis.

The mass spectrometer can include a sample plate to support a plurality of samples, and one or more translational stages to change the position of the sample plate relative to the electrodes to allow the mass spectrometer to analyze each of the different samples. The mass spectrometer can include a sample plate to support the sample, and at least one translational stage to change the position of the sample plate relative to the electrodes to allow the mass spectrometer to analyze each of different portions of the sample. The mass spectrometer can include a signal acquisition and instrument control device to control positioning of the sample plate, analyses of mass spectra of the various regions of the sample, and recording of data representing the mass spectra. The electrodes can be symmetrical with respect to a plane that passes the sample. The ion source can include at least one of a matrix-assisted laser desorption/ionization (MALDI) ion source, a surface-enhanced laser desorption ionization (SELDI) ion source, a laser ablation ion source, an electrospray ionization (ESI) ion source, an electron impact (EI) ion source, a secondary ion source, a fast atom bombardment (FAB) ion source, a laser-desorption post ionization source, or a chemical ionization (CI) ion source. The electrodes can include sets of electrodes to form a plurality of ion trajectory adjustment stages to adjust the positive ion trajectory and negative ion trajectory.

In another aspect, in general, an apparatus includes electrodes to change travel directions of positive ions and negative ions and accelerate the positive and negative ions, the electrodes having surfaces connected to a plurality of voltages, the surfaces generating electric fields forming a first trajectory adjustment stage, a first acceleration stage, a second trajectory adjustment stage, and a second acceleration stage. The electric field in the first trajectory adjustment stage changes the travel directions of the negative ions and causes the negative ions to travel toward the first acceleration stage, the electric field in the first acceleration stage accelerates the negative ions, the electric field in the second trajectory adjustment stage changes the travel directions of the positive ions and causes the positive ions to travel toward the second acceleration stage, and the electric field in the second acceleration stage accelerates the positive ions. A first average path represents an average of the paths traveled by the negative ions after passing the first acceleration stage, a second average path represents an average of the paths traveled by the positive ions after passing the second acceleration stage, and the second average path is at an angle in a range between 0 to 179 degrees relative to the first average path.

Implementations of apparatus may include one or more of the following features. The second average path is at an angle between 20-60 degrees relative to the first average path.

In another aspect, in general, a method of analyzing mass spectrum includes generating positive and negative ions from a sample positioned in an electric field; guiding, using a first portion of the electric field, the negative ions along a first path toward a first mass analyzer having a first flight tube that extends along a first axis; guiding, using a second portion of the electric field, the positive ions along a second path toward a second mass analyzer having a second flight tube that extends along a second axis, and the second axis is at an angle in a range between 0 to 179 degrees relative to the first axis; analyzing the negative ions using the first mass analyzer; and analyzing the positive ions using the second mass analyzer.

Implementations of method may include one or more of the following features. Guiding the negative ions can include passing the negative ions through openings in a grid of a negative ion extraction electrode having a voltage higher than that of a sample plate that holds the sample, and guiding the positive ions can include passing the positive ions through openings in a grid of a positive ion extraction electrode having a voltage lower than the sample plate. Guiding the negative ions can include passing the negative ions through openings in a grid of a negative ion acceleration electrode having a voltage higher than that of the sample plate, and guiding the positive ions can include passing the positive ions through openings in a grid of a positive ion acceleration electrode having a voltage lower than that of the sample plate. The method can include moving a sample plate supporting a plurality of samples and analyzing the mass spectrum of each of the different samples. The method can include moving a sample plate supporting the sample and analyzing the mass spectrum of each of different regions of the sample.

In another aspect, in general, an apparatus includes an ion source electrode, a first extraction electrode, and a second extraction electrode. The ion source electrode includes a sample surface on which a sample material is positioned, the sample material providing positive ions and negative ions when excited by a laser beam or an energetic particle beam. The first extraction electrode is connected to a voltage higher than the sample surface to attract the negative ions from the sample surface, the first extraction electrode having an opening to allow the negative ions to pass. The second extraction electrode is connected to a voltage lower than the sample surface to attract the positive ions from the sample surface, the second extraction electrode having an opening to allow the positive ions to pass. The first and second extraction electrodes are positioned symmetrically about the ion source electrode.

Implementations of the method may include one or more of the following features. The ion source electrode may include a first wall and a second wall, the first wall having a first opening to allow the negative ions to pass, the first wall being positioned between the sample surface and the first extraction electrode, the second wall having a second opening to allow the positive ions to pass, the second wall being positioned between the sample surface and the second extraction electrode. The sample surface, the first wall, and the second wall may have the same voltage. The apparatus may include a first mass analyzer to analyze the negative ions that pass the opening of the first extraction electrode, and a second mass analyzer to analyze the positive ions that pass the opening of the second extraction electrode. The first mass analyzer may include at least one of a time-of-flight mass spectrometer, a quadrupole mass spectrometer, an ion trap mass spectrometer, a magnet sector mass spectrometer, a Fourier-transform ion-cyclotron-resonance mass spectrometer, and a momentum analyzer. The first mass analyzer may include a first detector that includes at least one of a scintillation detector, a microchannel plate detector, an electron multiplier, and an electric current detector. The first and second walls may be symmetrical with respect to a plane that passes the sample material. The first and second extraction electrodes may be symmetrical with respect to a plane that passes the sample material. Each of the openings of the first and second walls may have an elongated shape. Each of the openings of the first and second walls may have a rectangular shape. The apparatus may include a third mass analyzer to ionize and to analyze neutral particles emitted from the sample material.

In another aspect, in general, an apparatus includes electrodes to change travel directions of positive ions and negative ions and accelerate the positive and negative ions, the electrodes having surfaces connected to a plurality of voltages, the surfaces generating electric fields forming a first trajectory adjustment stage, a first acceleration stage, a second trajectory adjustment stage, and a second acceleration stage. The electric field in the first trajectory adjustment stage changes the travel directions of the negative ions and causes the negative ions to travel toward the first acceleration stage. The electric field in the first acceleration stage accelerates the negative ions. The electric field in the second trajectory adjustment stage changes the travel directions of the positive ions and causes the positive ions to travel toward the second acceleration stage. The electric field in the second acceleration stage accelerates the positive ions.

Implementations of the method may include one or more of the following features. The apparatus may include an ion source to generate the positive and negative ions, the ion source including at least one of a laser ablation ion source, a matrix-assisted laser desorption/ionization (MALDI) ion source, a surface-enhanced laser desorption ionization (SELDI) ion source, an electrospray ionization (ESI) ion source, an electron impact (EI) ion source, a secondary ion source, a fast atom bombardment (FAB) ion source, and a chemical ionization (CI) ion source.

In another aspect, in general, a dual-polarity time-of-flight mass spectrometer includes a dual-polarity ion generator to generate positive ions and negative ions, a first flight tube to receive the beam of negative ions, a first ion detector to detect negative ions that travel in the first flight tube, a second flight tube to receive the beam of positive ions, and a second ion detector to detect positive ions that travel in the second flight tube. The dual-polarity ion generator includes an ion source to generate the positive ions and negative ions from a sample surface, and electrodes to generate electric fields for focusing and guiding the negative ions into a beam of negative ions, the electric fields also focusing and guiding the positive ions into a beam of positive ions.

Implementations of the method may include one or more of the following features. Guiding the negative ions toward the first mass analyzer may include passing the negative ions through a first opening defined by a first wall, and guiding the positive ions toward the second mass analyzer may include passing the positive ions through a second opening defined by a second wall. The method may include connecting the sample surface, the first wall, and the second wall to a same voltage. The method may include analyzing neutral molecules emitted from the material. The method may include positioning the first and second extraction electrodes symmetrically with respect to a plane that passes the sample material.

The sample surface may be positioned at a location subject to the influence of the first and third electric fields. The average acceleration energy of the negative ions in the first acceleration stage may be higher than the average acceleration energy of the negative ions in the first trajectory adjustment stage.

Advantages of the apparatuses and methods include one or more of the following. The mass spectrometer can be used to determine the mass spectra of samples placed on a sample plate that can accommodate several sample materials. The mass spectrometer can analyze different regions of a sample and generate an image of distribution of ions in the sample. Both positive and negative ions generated from the ion source region are analyzed simultaneously without the time-delay for polarity-switching, so the mass spectrometer can accurately measure both positive and negative ions in real-time. Owing to this characteristic, the sample composition of both charge polarities at many sampling positions can be determined unambiguously in many experiment events. Mass and structural information of materials can be obtained by comparing the spectral features of the positive and negative ions. Thus, the method can reveal valuable correlation between constituent molecules, such as in the analysis of biological tissues. The mass spectrometer can be used to investigate complicated sample mixtures. The mass spectrometer can be used to investigate the ionization properties of molecules in sample materials, as well as ionization mechanisms. The apparatus and method can be used in the analysis of condensed-phase samples on a surface. For example, biological tissue samples can be placed on a sample surface, and the negative ions and the positive ions generated from the samples can be analyzed simultaneously. The apparatus can also simultaneous analyze neutral compositions produced in the ionization reaction by providing a post-ionization module in the propagation path of the neutral molecules. In addition, the apparatus and method can be used in the analyses of components of surfaces of materials. For example, the components of a biological tissue or impurities on a selected spot of a semiconductor chip can be analyzed by monitoring both positive and negative ions simultaneously.

DESCRIPTION

System Overview

Figure 1:
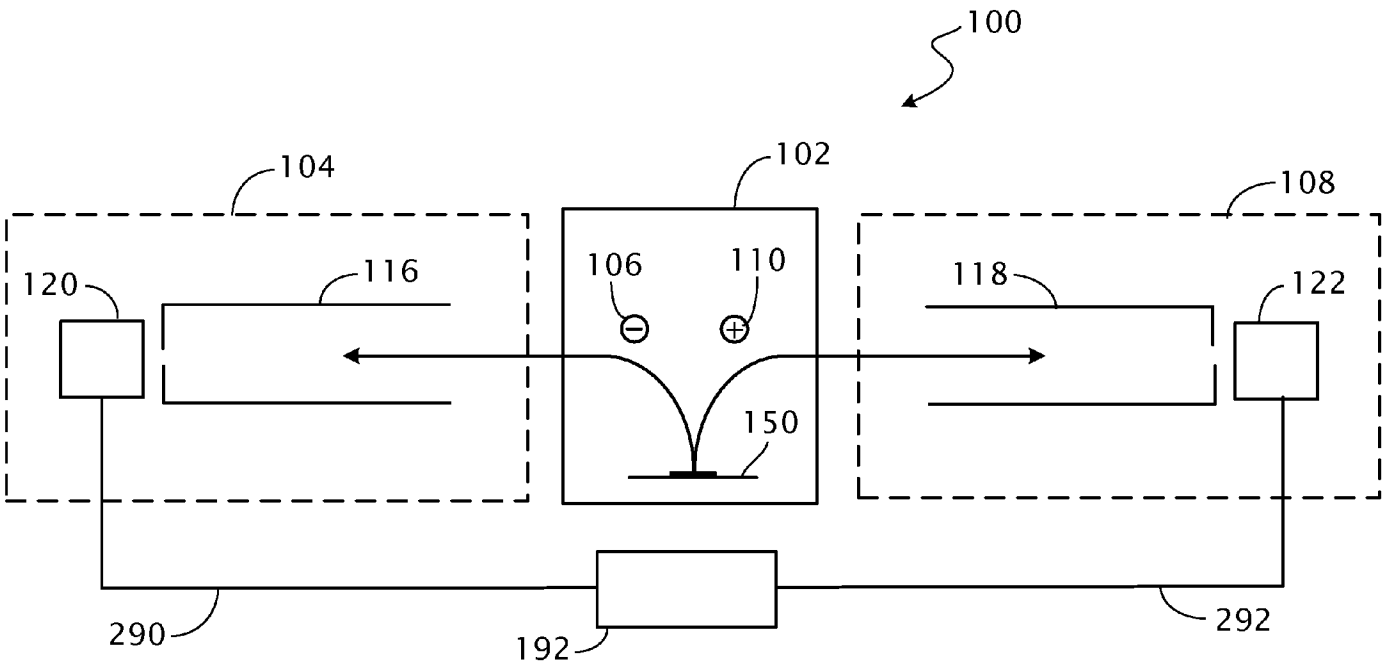
FIGS. 1 and 2 are schematic diagrams of a dual-polarity mass spectrometer.

Referring to FIG. 1, a dual-polarity time-of-flight (DTOF) mass spectrometer (MS) 100 can simultaneously determine the mass spectra of negative ions 106 and positive ions 110. The negative and positive ions can be generated from a sample material positioned on a surface 150 of a source electrode of an dual-polarity ion generator 102 using, for example, the matrix-assisted laser desorption/ionization (MALDI) method. Once the negative and positive ions have been produced, the negative and positive ions will be extracted simultaneously toward a negative mass spectrometer 104 and a positive ion mass spectrometer 108, respectively.

The negative mass spectrometer 104 includes a flight tube 116 and a negative ion detector 120 that detects negative ions 106 traveling through the flight tube 116. The positive mass spectrometer 108 includes a flight tube 118 and a positive ion detector 122 that detects positive ions 110 traveling through the flight tube 118. The negative and positive mass analyzers 104 and 108 are positioned on opposite sides of the ion generator 102 and can be, e.g., symmetrical with respect to the ion generator 102. Output signals 290 and 292 of the detectors 120 and 122, respectively, are sent to a signal acquisition and instrument control device 192 (e.g., a digital storage oscilloscope or a computer), to record the mass spectra of the negative and positive ions.

Figure 2:
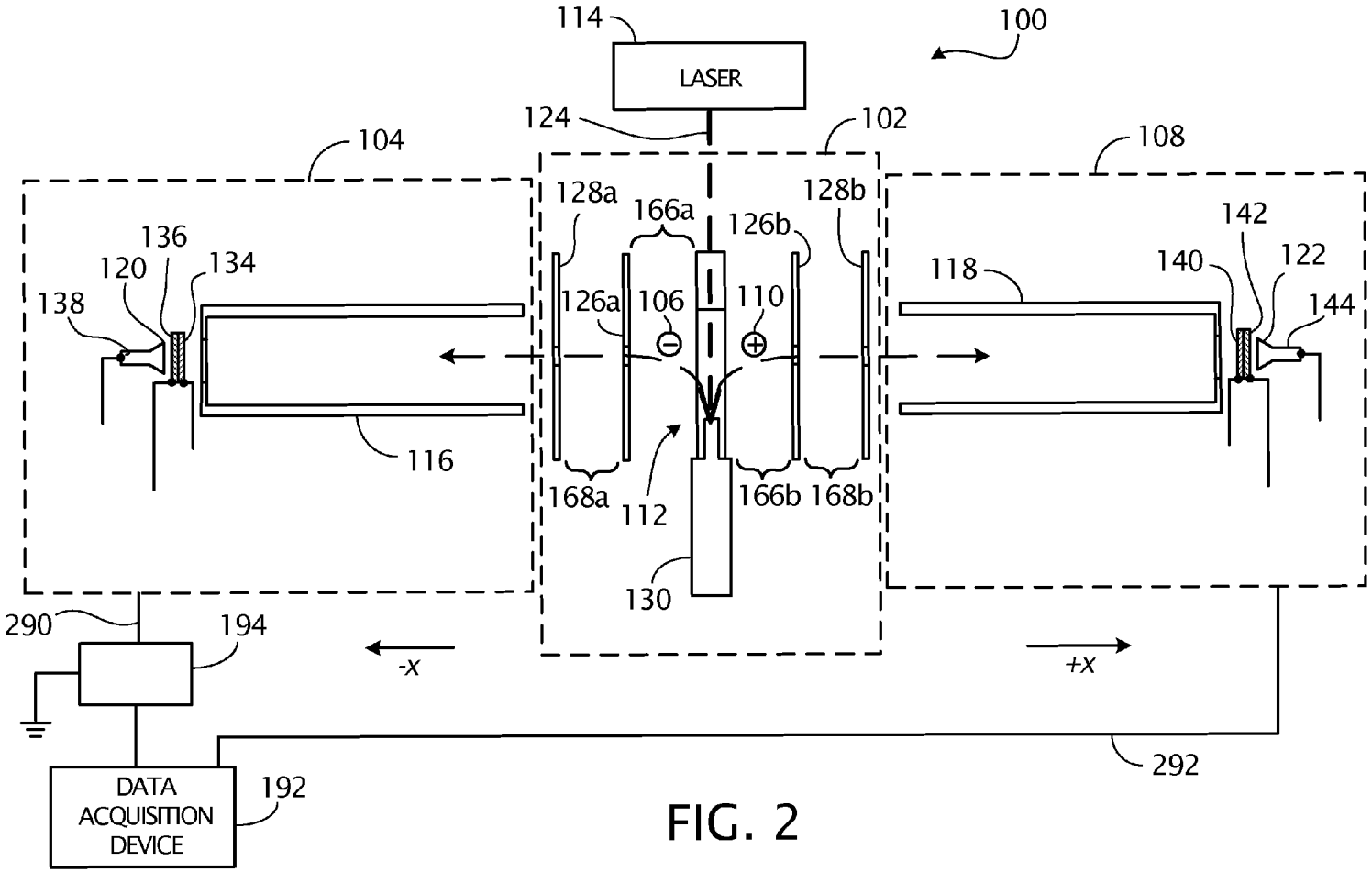

FIG. 2 is a schematic diagram of an example of the dual-polarity time-of-flight mass spectrometer 100 that generates negative and positive ions 106, 110 using a matrix-assisted laser desorption/ionization (MALDI) ion source 112. The MALDI source 112 includes a sample material 146 embedded in a matrix. A laser source 114 generates a laser beam 124 that irradiates the sample 146 to generate the positive and negative ions 110, 106.

The sample material 146 can be, for example, salts, alloys, semiconductor materials, semiconductor chips, particles, chemicals, biomolecules, physiological fluids, biological tissues, skins, metals, and plasma (which can include a gaseous beam composed of neutral and charged particles). The mass spectrometer 100 can analyze the sample material 146 by using the laser beam 124 to probe the sample and cause the positive and negative ions to be emitted from the sample.

Using the mass spectrometer 100 to analyze a sample material does not require generating small neutral particles from the sample material prior to ionization, as is the case for aerosol time-of-flight mass spectrometers (ATOF MS). In aerosol TOF MS, neutral particles are derived from the sample material and propagated along a path and ionized by a laser beam when the flying particles reach an ionization location. Thus, it may be difficult to use the aerosol TOF MS to analyze the surface properties of a bulk sample material without dividing the sample material into very small pieces. By comparison, the sample material used in the mass spectrometer 100 may have dimensions of several millimeters, or even larger, as long as the sample material can be accommodated in the ion source electrode described below. Thus, the mass spectrometer 100 can be used to examine the surface properties of, e.g., a semiconductor chip or a piece of biological tissue.

The ion generator 102 includes an ion source electrode 130 and extraction electrodes 126*a*, 126*b*, 128*a*, and 128*b*. The source electrode 130 includes a sample surface 150 (see FIGS. 3 and 4) on which the sample 146 is placed. The source electrode 130 and extraction electrodes 126*a*, 126*b*, 128*a*, and 128*b* are configured to generate electric fields having distributions for guiding and accelerating the negative and positive ions in opposite directions, and directing the negative and positive ions toward the flight tubes 116 and 118, respectively.

In some examples, the extraction electrodes 126*a* and 126*b* are positioned on opposite sides of the ion source electrode 130 and are symmetrical with respect to the ion source electrode 130. Similarly, the extraction electrodes 128*a* and 128*b* are positioned on opposite sides of the ion source electrode 130 and are symmetrical with respect to the ion source electrode 130.

There are five electric fields generated by the source electrode 130 and extraction electrodes 126*a*, 126*b*, 128*a*, and 128*b*. A first electric field is located in the open region 300 surrounded on three sides by the sample surface 150 and the inner surfaces of the walls 160 and 162. A second electric field is located between the source electrode 130 and the extraction electrode 126*a*. A third electric field is located between the source electrode 130 and the extraction electrode 126*b*. A fourth electric field is located between the extraction electrodes 126*a* and 128*a*. A fifth electric field is located between the extraction electrodes 126*b* and 128*b*. The second and third electric fields are symmetrical with respect to the ion source electrode 130, except that the polarities of the second and third electric fields with respect to the source electrode 130 are opposite. Similarly, the fourth and fifth electric fields are symmetrical with respect to the ion source electrode 130, except that the polarities of the fourth and fifth electric fields with respect to the source electrode 130 are opposite.

In this description, a Cartesian coordinate system having x-, y-, and z-axes is used to describe the orientations of the components of the mass spectrometer 100. The origin of the axes is at the center of the sample surface 150 (see FIG. 4) where the sample material 146 is located. The z-axis is normal to the sample surface 150. The axes of the flight tubes 116 and 118 are parallel to the x-axis. Negative ions 106 and positive ions 110 propagate along −x and +x directions in the flight tubes 116 and 118, respectively.

In some examples, the extraction electrode 126*a* has a voltage higher than the ion source electrode 130 to generate an electric field that forms a first acceleration stage 166*a* to accelerate negative ions 106 toward the −x direction. The extraction electrode 128*a* has a voltage slightly lower than the extraction electrode 126*a* to generate an electric field that focuses the negative ions 106 and adjusts the trajectory of the ions 106 so that the ions 106 travel along paths parallel to the axis of the flight tube 116.

The extraction electrode 126*b* has a voltage lower than the ion source electrode 130 to generate an electric field that forms a first acceleration stage 166*b* to accelerate positive ions 110 toward the +x direction. The extraction electrode 128*b* has a voltage slightly higher than the extraction electrode 126*b* to generate an electric field that focuses the positive ions 110 and adjusts the trajectory of the ions 110 so that the ions 110 travel along paths parallel to the axis of the flight tube 118.

In some examples, the voltages applied to the extraction electrodes 126*a* and 128*a* and the voltages applied to the extraction electrodes 126*b* and 128*b* are symmetrical with respective to the voltage of the ion source electrode 130, except that they have opposite polarities with respect to the voltage of the ion source electrode 130. This means that, for example, the voltage of the extraction electrode 126*a* is higher than the ion source electrode 130 by an amount that is the same as the amount that the voltage of the extraction electrode 126*b* is lower than the ion source electrode 130.

The negative ion detector 120 can be, e.g., a microchannel plate detector. Similarly, the positive ion detector 122 can be, e.g., a microchannel plate detector. The negative and positive mass analyzers 104 and 108 are positioned on opposite sides of the ion generator 102. The negative and positive mass analyzers 104 and 108 can be, e.g., symmetrical with respect to the ion generator 102. The ion generator 102 is housed in a source chamber (not shown), e.g., a six-way cube chamber, having openings for coupling to the flight tubes 116 and 118.

The output signal 292 of the positive ion detector 122 is measured by a first channel of the data acquisition device 192. The output signal 290 of the negative ion detector 120 is terminated through a circuit 194 and measured by a second channel of the data acquisition device 192. As will be described later, the circuit 194 includes voltage isolation circuitry to prevent the high voltages applied to the negative ion detector 120 from damaging the data acquisition device 192.

Figure 3:
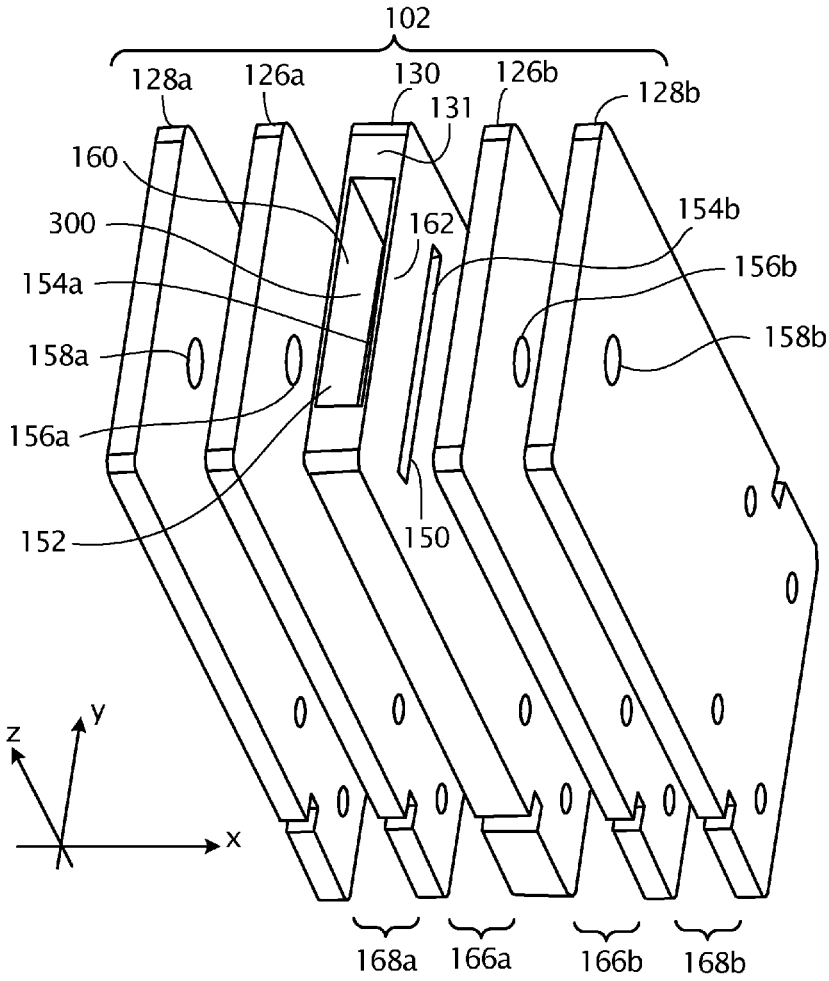
FIG. 3 is a schematic diagram of a dual-polarity ion generator.

Referring to FIG. 3, the ion source electrode 130 includes an open region 300 defined by the sample surface 150 and walls 160 and 162. The laser beam 124 passes the open region 300 to irradiate the sample material 146 positioned on the sample surface 150. The wall 160 has a rectangular slot (opening) 154*a* (blocked from view in FIG. 3) to allow negative ions 106 to pass and travel toward the extraction electrode 126*a*. The wall 162 has a rectangular slot 154*b* to allow positive ions 110 to pass and travel toward the extraction electrode 126*b*. The sample surface 150, the wall 160, and the wall 162 are electrically connected and all have the same electric potential.

The ion source electrode 130 and the extraction electrodes 126*a* and 128*a* form two acceleration stages 166*a* and 168*a* for the negative ions. The ion source electrode 130 and the extraction electrodes 126*b* and 128*b* form two acceleration stages 166*b* and 168*b* for the positive ions. The ion source electrode 130 and the extraction electrodes 126*a*, 128*a*, 126*b*, and 128*b* can be, e.g., stainless steel electric plates that are spaced equally apart from one another. The surface of the steel electric plates can be parallel to one another.

Figure 4:
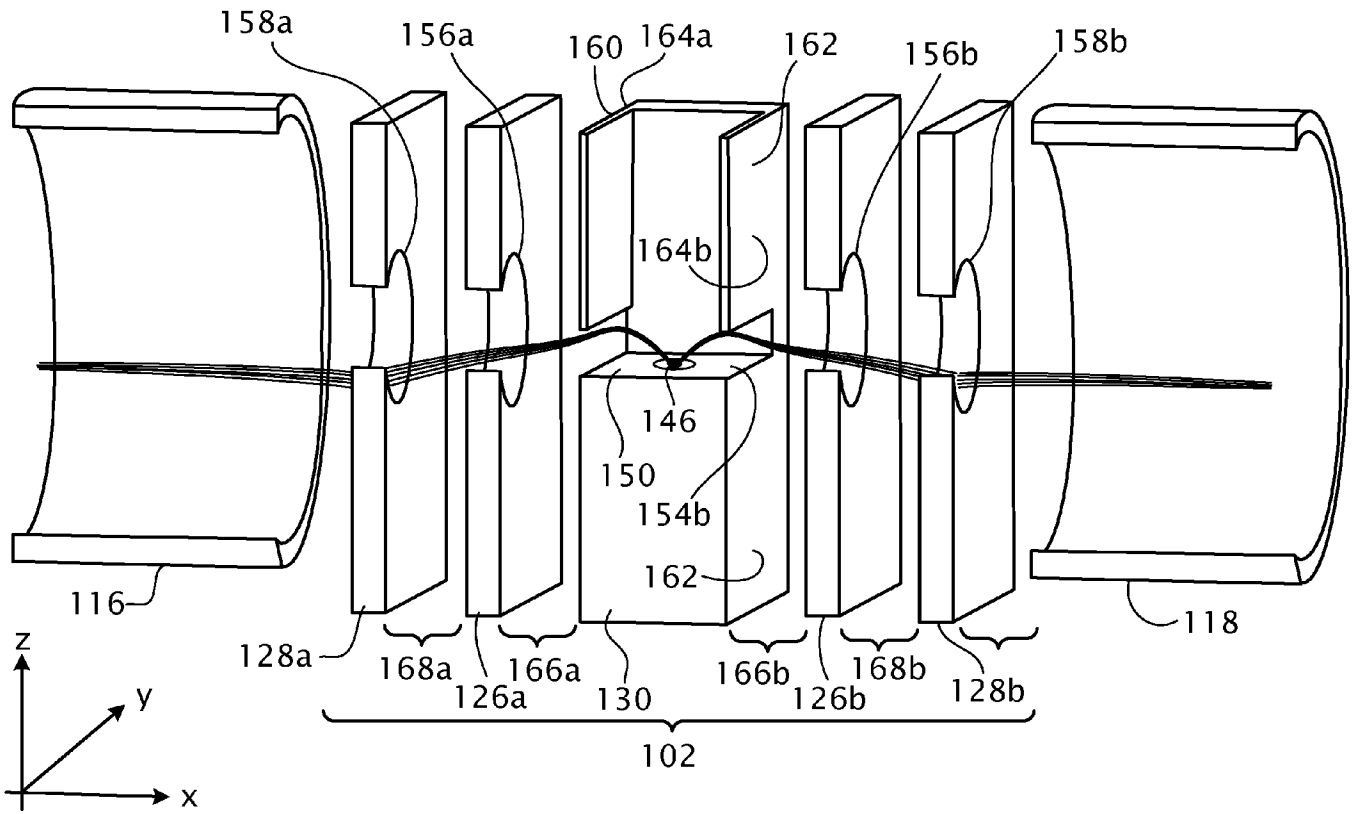
FIG. 4 is cross sectional diagram of the dual-polarity ion generator.

FIG. 4 is a cross sectional diagram of the ion generator 102 and the flight tubes 116 and 118. The regions inside the flight tubes 116 and 118 are mostly field-free drift regions. The extraction electrodes generate electric potentials that guide the ions along trajectories parallel to the axes of the flight tubes 116 and 118, to ensure that the ions reach the ion detectors 120 and 122 after traveling through the length of the flight tubes.

A feature of the ion generator 102 is that the desorbed ions are emitted from the sample surface 150 in a generally upwards (+z) direction. The ions are then guided by the electric fields produced by the electrode 130 and the extraction electrodes 126*a*, 126*b*, 128*a*, and 128*b*. Negative ions are focused and directed towards a direction parallel to the axis of the flight tube 116. Positive ions are focused and directed towards a direction parallel to the axis of the flight tube 118.

Another feature of the ion generator 102 is the use of rectangular slots 154*a* and 154*b* near the sample surface 150. The rectangular slots 154*a* and 154*b* are defined by surfaces 160 and 162, respectively, of the ion source electrode 130. Using a rectangular opening is better than using a circular opening or a wide-open structure (without the upper portion of the surfaces 160 and 162) because a rectangular opening generates a field-gradient that is less distorted along the y-axis. The electric field generated by the ion source electrode 130 and the extraction electrodes 126*a* and 126*b* has a better shape that can guide the positive and negative ions along trajectories toward the flight tubes 118 and 116, respectively.

Having openings that are elongated in the y direction, where the openings are positioned near the sample material 146, can result in an electric field that is substantially constant along the y axis in the vicinity of the sample material 146. This helps in focusing the ions and directing the ions toward the flight tubes 116 and 118.

When the ions are desorbed from the sample 146, a large portion of the ions may initially travel along the +z direction, then gradually turn toward the x axis (negative ions toward −x direction and positive ions toward +x direction). Using positive ions 110 as an example, when the ions 110 are emitted from the sample surface 150, the ions 110 may initially travel in the +z-direction and then be slightly pulled back in the −z direction by the electric field gradient. After the positive ions 110 pass the rectangular slot 154*b*, the positive ions 110 travel through the first and second acceleration regions 166*b* and 168*b* and enter the field-free flight tube 118.

The arrangement of the rectangular slot 154*b* and the circular openings 156*b* and 158*b* provides adequate transmission efficiency, meaning that a large portion of the positive ions 110 can reach the flight tube 118 without hitting the walls of the ion source electrode 130 and the extraction electrodes 126*b* and 128*b*. The voltage of the second extraction electrode 128*b* is higher relative to the flight tube 118 and the first extraction electrode 126*b*. This configuration produces an ion-focusing effect near the opening 158*b* and can increase the transmission efficiency of the positive ions 110 by, e.g., about a factor of two.

The arrangements of the extraction electrodes 126*a* and 128*a*, and holes 156*a* and 158*a*, mirror those of the extraction electrodes 126*b* and 128*b*, and holes 156*b* and 158*b*, respectively, with respect to the ion source electrode 130.

Figure 5:
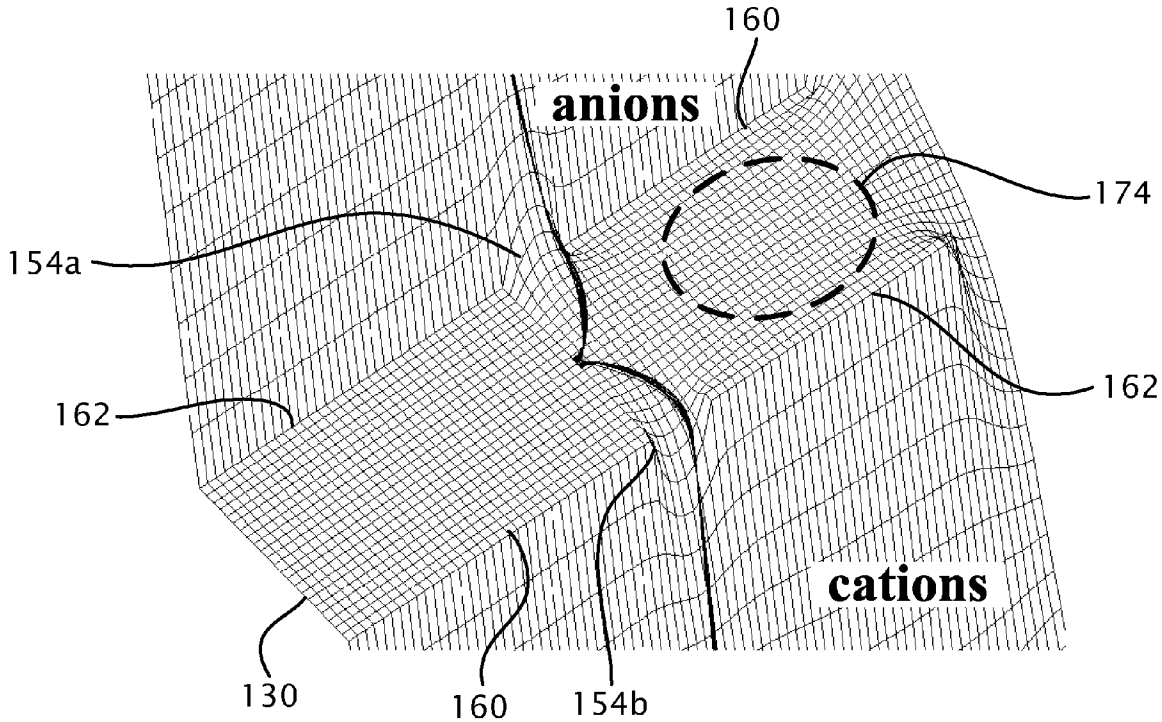
FIG. 5 is a graph showing electric potential fields.

FIG. 5 shows a mesh plot of the electric potential in and near the ion source electrode 130. In this example, because the walls 160 and 162 have the same electric potential, the region 174 above the sample surface 150 has a substantially constant electric potential. Due to influence from the extraction electrode 126*a*, which has a higher voltage than the ion source electrode 130, the electric potential near the rectangular slot 154*a* is higher than the region 174.

The ion source electrode 130 and the extraction electrodes 126*a* and 126*b* generate an electric field having a particular distribution that adjusts the trajectories of the negative and positive ions after the ions are emitted from the sample surface 150. The electric field forms a trajectory adjustment stage for each of the negative and positive ions 106, 110. For example, the negative and positive ions 106, 110 initially travel along generally +z direction when emitted from the sample surface 150. The electric field distribution adjusts the trajectory of the negative ions 106 and guides the negative ions 106 from the generally +z direction to a generally −x direction toward the rectangular slot 154*a*. Similarly, the electric field distribution adjusts the trajectory of the positive ions 110 and guides the positive ions 110 from the generally +z direction to a generally +x direction toward the rectangular slot 154*b*.

When the negative and positive ions 106 and 110 travel from the sample surface 150 to the rectangular slots 154*a* and 154*b*, respectively, the acceleration of the negative and positive ions 106, 110 is small compared to the acceleration of the ions in the acceleration stages 166*a* and 166*b*.

The electric field in the region surrounded by the sample surface 150 and the walls 160 and 162 redirects the negative ions 106 from traveling in generally +z directions to generally −x directions. Therefore, negative ions 106 having substantially the same mass-to-charge ratios will have substantially the same speeds when passing the rectangular slot 154*a*, have substantially the same acceleration in the first and second acceleration regions 166*a* and 168*a*, and have substantially the same speeds when entering the flight tube 116. Similarly, the positive ions 110 having substantially the same mass-to-charge ratios will enter the flight tube 118 with substantially the same speeds.

Figure 6:
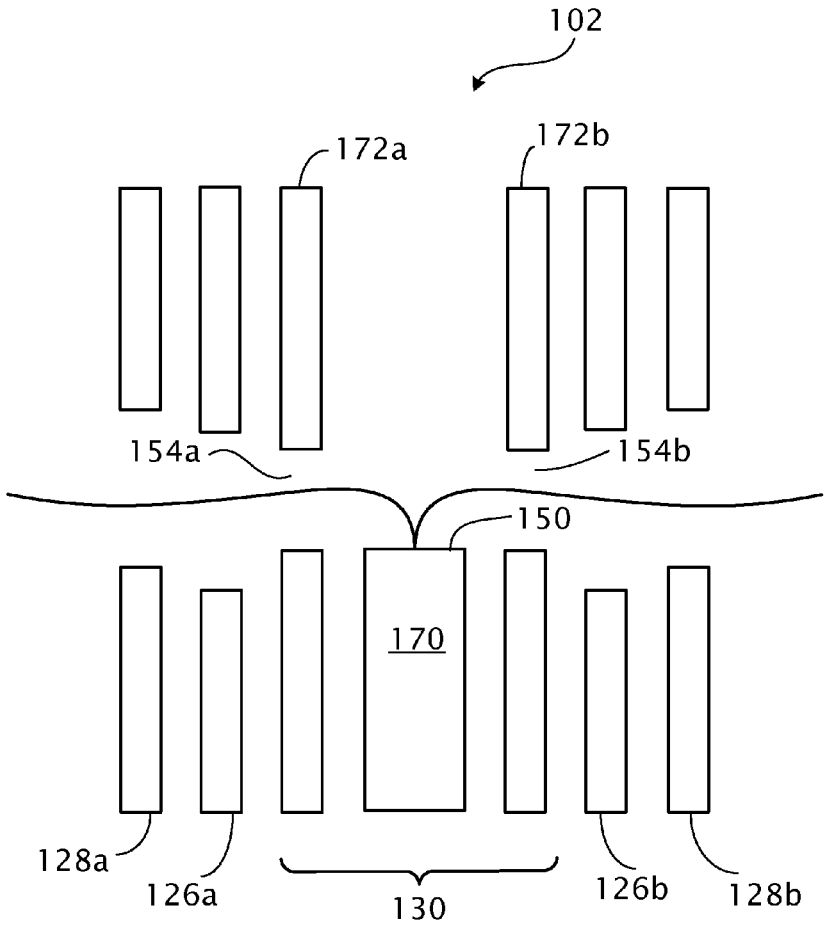
FIG. 6 is a cross sectional diagram of a dual-polarity ion generator.

Referring to FIG. 6, the ion source electrode 130 can also include separate components, such as a center plate 170 and two adjacent plates 172*a* and 172*b*. The center plate 170 has a sample surface 150 on which a sample material 146 is placed. The plates 172*a* and 172*b* have rectangular slots 154*a* and 154*b*, respectively, similar to those shown in FIG. 4. The center plate 170 and the adjacent plates 172*a* and 172*b* are electrically connected and have the same electric potential.

Experimental Setup and Measurement Results

The following describes an example of the dual-polarity time-of-flight mass spectrometer 100 that was used to conduct the experiments. The ion source electrode 130 and extraction electrodes 126*a*, 126*b*, 128*a*, and 128*b* each has a width×length of 40 mm×100 mm, and are equally spaced apart by 6 mm from each other. The sample electrode 130 has a thickness of 6 mm. The extraction electrodes 126*a*, 126*b*, 128*a*, and 128*b* each has a thickness of 3 mm. Each of the rectangular slots 154*a* and 154*b* has a dimension of 26 mm×3 mm, and is located at 18 mm away from the front side 131 of the sample plate. Each of the circular openings 156*a*, 156*b*, 158*a*, and 158*b* has a diameter of 5 mm. The centers of the openings 156*a* and 156*b* are spaced 1.5 mm away from the x-axis in the +z direction, and the centers of the openings 158*a* and 158*b* are spaced 2.5 mm away from the x-axis in the +z direction.

The flight tubes 116 and 118 each has an inner diameter of 32 mm and a length of 1123 mm, and are electrically isolated from the extraction electrodes 128*b* and 128*a*, respectively. The pressure in the source chamber was maintained below $3\times10^{-7}$ mbar during measurement. Both of the flight tubes 116, 118 have center axes that are parallel to the x-axis and aligned 2.5 mm offset from the x-axis in the +z direction, and they are differentially pumped to below $5\times10^{-7}$ mbar. The microchannel plate detectors 120 and 122 are located about 25 mm away from the flight tubes 116 and 118, respectively, without additional differential pumping stages.

The voltages are applied continuously to the source electrode 130 and the extraction electrodes 126*a*, 126*b*, 128*a*, and 128*b*. A reference voltage of +5.9 kV is applied to the ion source electrode 130. The voltages applied to the extraction electrodes and the ion detectors are symmetrical with respect to the reference voltage except for having opposite polarities. The voltages applied to the first set of extraction electrodes 126*a* and 126*b* are +2.5 kV and +9.3 kV, respectively. The voltage potential of the second set of extraction electrodes 128*a* and 128*b* are +3.8 kV and +8 kV, respectively. The voltages applied to the flight tubes 118 and 116 are 0 V and +11.8 kV, respectively.

The circuits of the detectors 120 and 122 are different because the positive ion detector 122 is operated at a lower voltage range, while the negative ion detector 120 is operated at a higher voltage range. The microchannel plate detector 122 has entrance side 140, exit side 142, and anode 144 that are connected to voltages −2200 V, −200 V, and 0 V, respectively. By comparison, the microchannel plate detector 120 has entrance side 134, exit side 136, and anode 138 that are connected to voltages +14 kV, +16 kV, and +16.2 kV, respectively.

Because of the high bias voltages used in the negative ion detector 120, the microchannel plate assembly was isolated and positioned 67 mm away from the vacuum chamber (of the flight tubes) by using an 8-inch acryl flange adaptor. The frame of the detector assembly was biased at +14 kV to reduce the voltage differences around the electrodes, thereby preventing the negative ion detector 120 from high voltage breakdown during operation.

For the data acquisition device 192, a 500 MHz digital storage oscilloscope was used. Because the oscilloscope 192 accepts signals of a few volts, a DC decoupling circuit was used to isolate the high bias voltages of the microchannel plate detector 120 from the oscilloscope 192.

Figure 7:
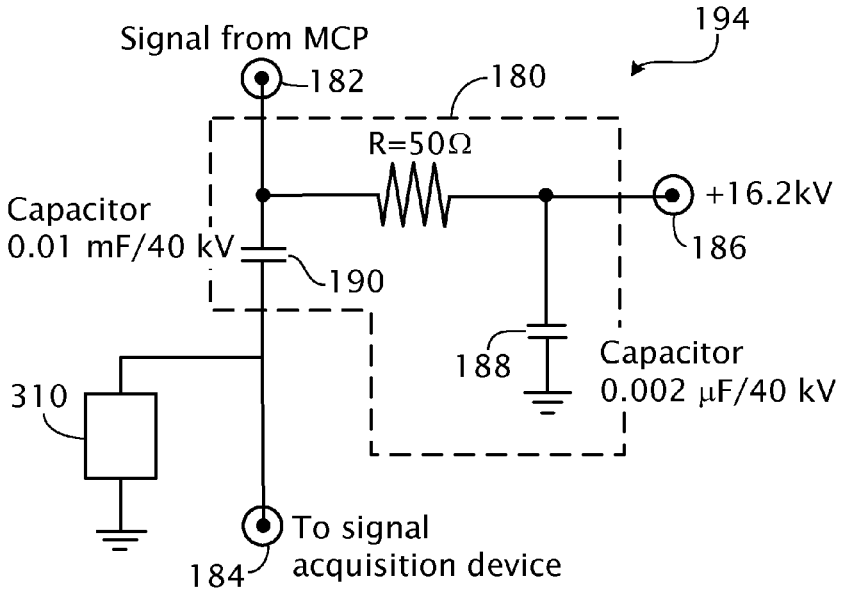
FIG. 7 is a circuit diagram of a high voltage decoupler.

Referring to FIG. 7, a circuit 194 was used to terminate the signal from the microchannel plate detector 120. The circuit 194 includes a DC decoupling circuit 180 for decoupling the microchannel plate detector 120 from the digital storage oscilloscope 192. The decoupling circuit 180 has a node 182 that receives signals from the microchannel plate detector 120, a node 184 that connects to the digital storage oscilloscope 192, and a node 186 that connects to +16.2 kV. The decoupling circuit 180 isolates the digital storage oscilloscope 192 from the +16.2 kV bias signal from the negative ion detector 120.

The decoupling circuit 180 includes two capacitors 188 and 190 that have high voltage ratings. For example, the capacitors 188 and 190 can be high voltage ceramic capacitors having capacitances 2 nF and 10 nF, respectively, each having a rating of 40 kV. The circuit 180 is enclosed in a glass housing that is electrically isolated from the ambient environment. Most of the conducting wires at the high-voltage side of the capacitors are silicone jacked with voltage ratings of, e.g., 100 kV. The capacitors are not shielded with grounding jackets to prevent short circuiting the circuit 180.

The signal 290 from the microchannel plate detector 120 passes the DC decoupling circuit 180 and is terminated by a resistor 310. The signal 290 is measured by a first channel of the digital storage oscilloscope 192. By comparison, the signal 292 from the microchannel plate detector 122 is directly terminated by another resistor and measured by a second channel of the digital storage oscilloscope 192.

A pulsed frequency-triplet Nd:YAG laser (355 nm) is used as the laser source 114. The power of the laser beam 124 is attenuated to about 2-10 μJ, depending on the sample 146 to be examined. The laser beam 124 passes a fused silica window of the source chamber to irradiate the sample 146. The laser beam 124 is aligned perpendicular to the sample surface 150.

The following describes results from experiments using the example of the mass spectrometer 100 described above. A number of biological samples were used in the experiments, including insulin chain B (M.W.=3495.9 Da), equine skeletal muscle myoglobin (M.W.=16951.5 Da), and a calibration protein mixture that includes angiotensin I (M.W.=1296.7 Da), adrenocorticotropic hormone (ACTH) clip 1-17 (M.W.=2093.1 Da), ACTH clip 18-39 (M.W.=2065.2 Da), ACTH clip 7-38 (M.W.=3657.9 Da), and insulin (M.W.=5730.6 Da). Here, "M.W." refers to molecular weight.

Figures 8A, 8B:
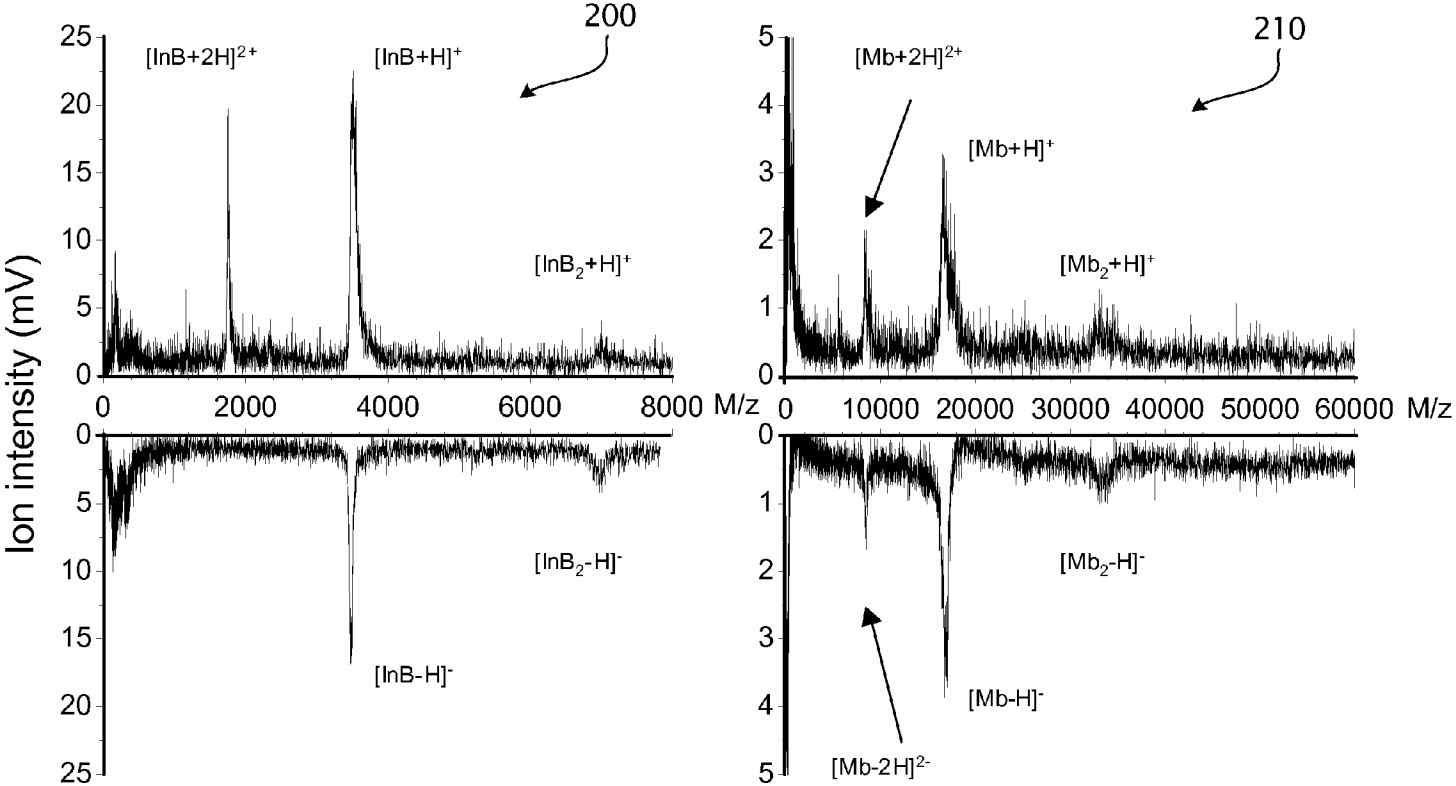
FIGS. 8A and 8B show mass spectra.

The experiments measured proteins and protein mixtures of various molecular weights. FIG. 8A is a graph 200 that shows the cation/anion spectra of 50 pmole insulin B chain with THAP as the matrix. The spectra were obtained based on about 200 laser events.

FIG. 8B is a graph 210 that shows the cation/anion spectra of myoglobin with CHCA as the matrix. The spectra were obtained based on about 1000 laser events.

Figure 9:
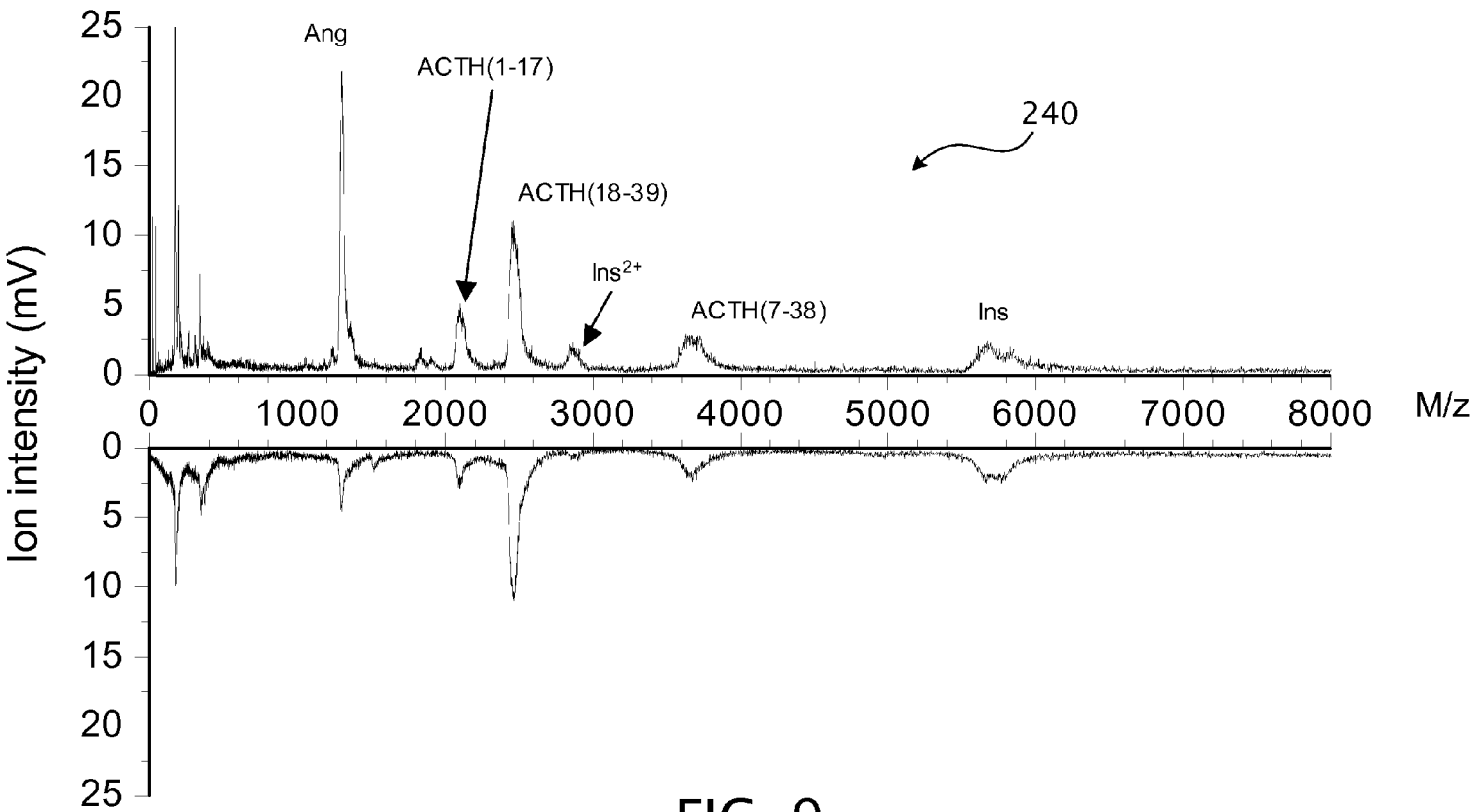
FIG. 9 is a graph showing mass spectra.

FIG. 9 is a graph 240 showing a mass spectrum of positive and negative ions generated from a protein calibration mixture. The mixture was prepared using 20 pmole of angiotensin I, 20 pmole of ACTH clip 1-17, 15 pmole of ACTH clip 18-39, 30 pmole of ACTH clip 7-38, and 35 pmole of insulin. All of the proteins, either positively or negative charged, were identified unambiguously in the graph 240.

Figure 10:
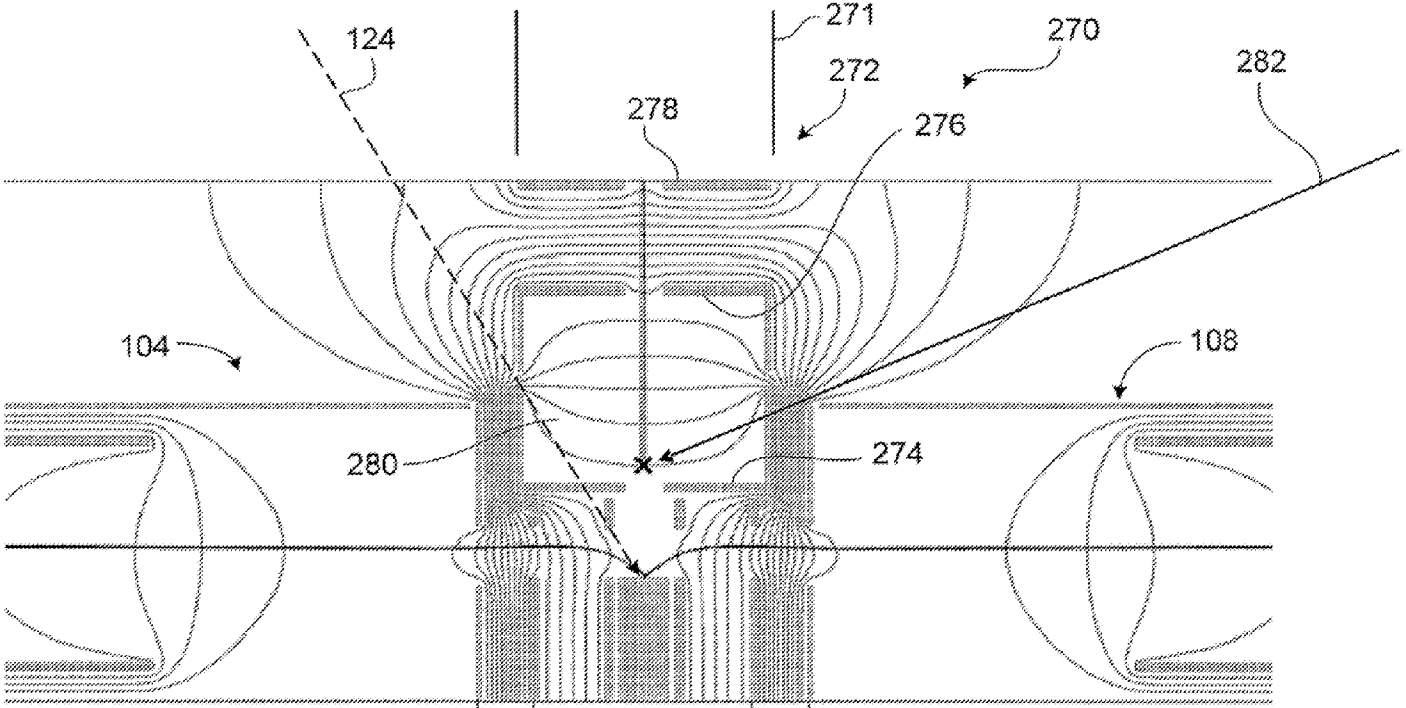
FIG. 10 is a schematic diagram of a mass spectrometer that can analyze cations, anions, and neutral particles.

FIG. 10 is a cross sectional diagram of an example of a mass spectrometer 270 that can analyze positive ions, negative ions, and neutral particles simultaneously. The mass spectrometer 270 can be used to study various types of positive and negative ions and neutral particles generated in MALDI and investigate the energetics of proteins as well as their interactions in protein complexes in electrically neutral systems.

The spectrometer 270 includes a negative mass spectrometer 104 for analyzing the negative ions, a positive mass spectrometer 108 for analyzing the positive ions, and a third mass analyzer 272 for analyzing neutral particles. The third mass analyzer 272 includes an ionization region 280 defined by electrodes 274 and 276 that are positioned in front (i.e., in the +z direction) of the ion source electrode 130. When neutral particles emitted from the sample material reach a location (marked by "X" in FIG. 10), the neutral particles are ionized by a laser beam 282 (e.g., an 248 nm excimer laser) or an electron beam. The electrodes 274 and 276, and an additional electrode 278 have voltages that generate an electric field gradient that accelerates the ionized particles toward a flight tube 271 of the third mass analyzer 272.

Angled DPTOF Mass Spectrometer

Figure 11:
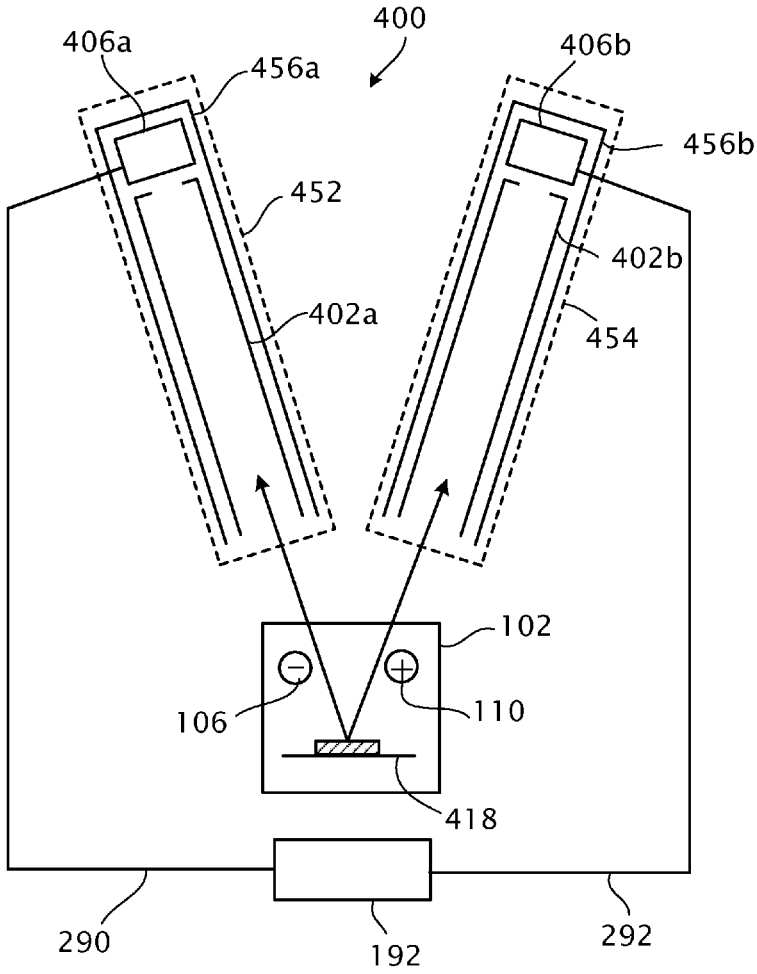
FIG. 11 is a diagram of an example angled dual-polarity time-of-flight (ADTOF) mass spectrometer.

Referring to FIG. 11, an angled dual-polarity time-of-flight (ADTOF) mass spectrometer (MS) 400 can be used to determine the mass spectra of samples placed on a sample plate that can accommodate an array of sample materials. The mass spectrometer 400 allows the use of large sample plates to reduce the time for exchanging samples. The mass spectrometer 400, similar to the mass spectrometer 100, can simultaneously determine the mass spectra of negative ions 106 and positive ions 110. The negative and positive ions can be generated from a sample material positioned on a surface of a sample plate 418 of a dual-polarity ion generator 102 using, for example, the matrix-assisted laser desorption/ionization (MALDI) method, laser desorption ionization, laser ablation, surface-assisted laser desorption ionization, laser desorption-post ionization, fast atom/ion bombardment, and secondary ion mass spectrometry methods, desorption electrospray ionization, etc. Once the negative and positive ions have been produced, the negative and positive ions will be extracted simultaneously toward a negative mass spectrometer 452 and a positive ion mass spectrometer 454, respectively.

In some implementations, the negative mass spectrometer 452 includes a flight tube 402*a* and a negative ion detector 406*a* that detects negative ions 106 traveling through the flight tube 402*a*. The flight tube 402*a* and ion detector 406*a* are enclosed inside a vacuum housing 456*a*. The positive mass spectrometer 454 includes a flight tube 402*b* and a positive ion detector 406*b* that detects positive ions 110 traveling through the flight tube 402*b*. The flight tube 402*b* and ion detector 406*b* are enclosed inside a vacuum housing 456*b*. The flight tubes 402*a* and 402*b* are collectively referenced as 402. The ion detectors 406*a* and 406*b* are collectively referenced as 406. The axes of the negative and positive mass analyzers 452 and 454 are oriented at an angle relative to each other, and the angle can be, e.g., between 0 to 179 degrees, or in some examples about 30 degrees. Output signals 290 and 292 of the detectors 406*a* and 406*b*, respectively, are sent to a signal acquisition device 192 (e.g., a digital storage oscilloscope or a computer), to record the mass spectra of the negative and positive ions.

Figure 12A:
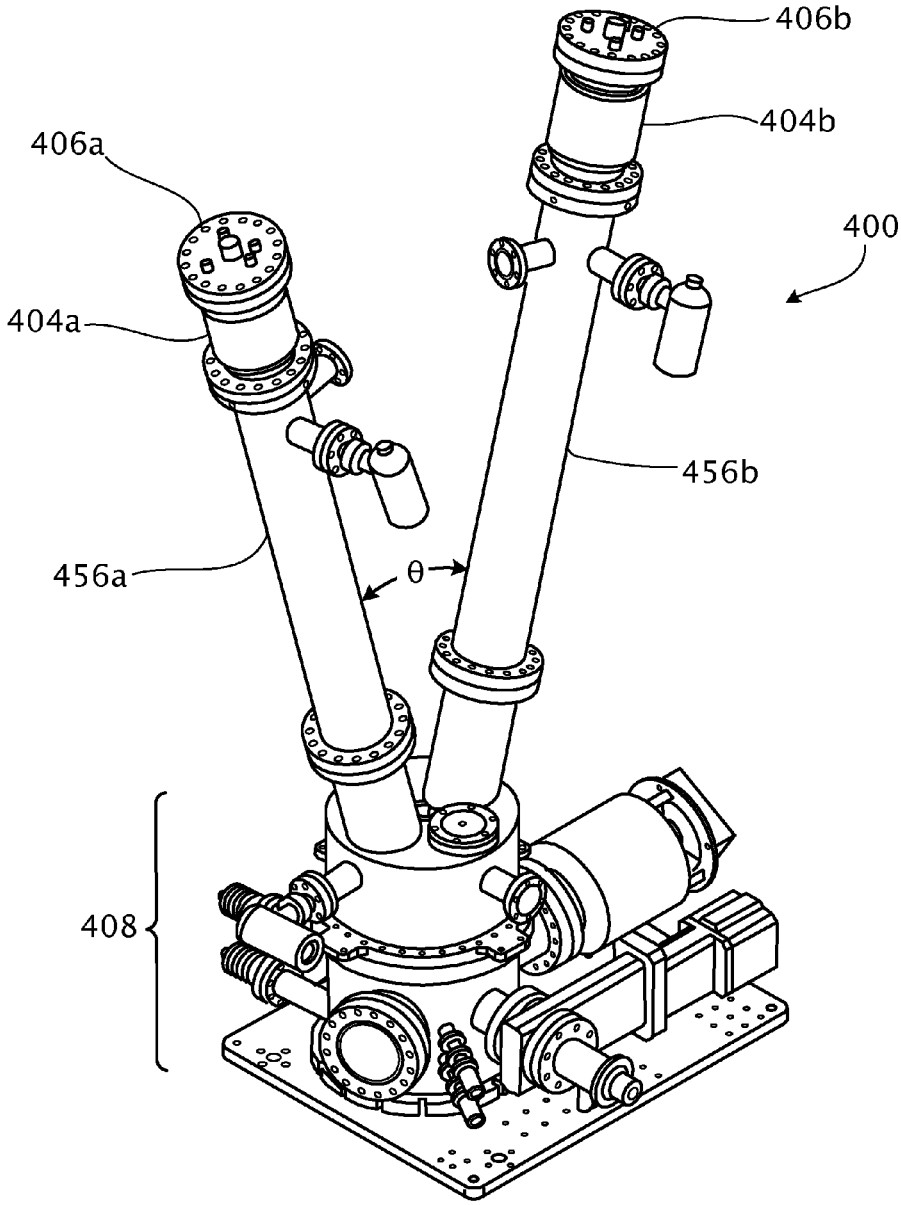
FIG. 12A is a perspective view of an example angled dual-polarity time-of-flight (ADTOF) mass spectrometer.

FIG. 12A is a perspective view of an example ADTOF mass spectrometer 400 includes flight tubes 402*a* (enclosed in vacuum housing 456*a*) and 402*b* (enclosed in vacuum housing 456*b*) that are oriented at an angle θ relative to each other, where θ is less than 180 degrees. For example, θ can be in a range from 0 to 179 degrees, or in some implementations between 20-60 degrees.

Figure 12B:
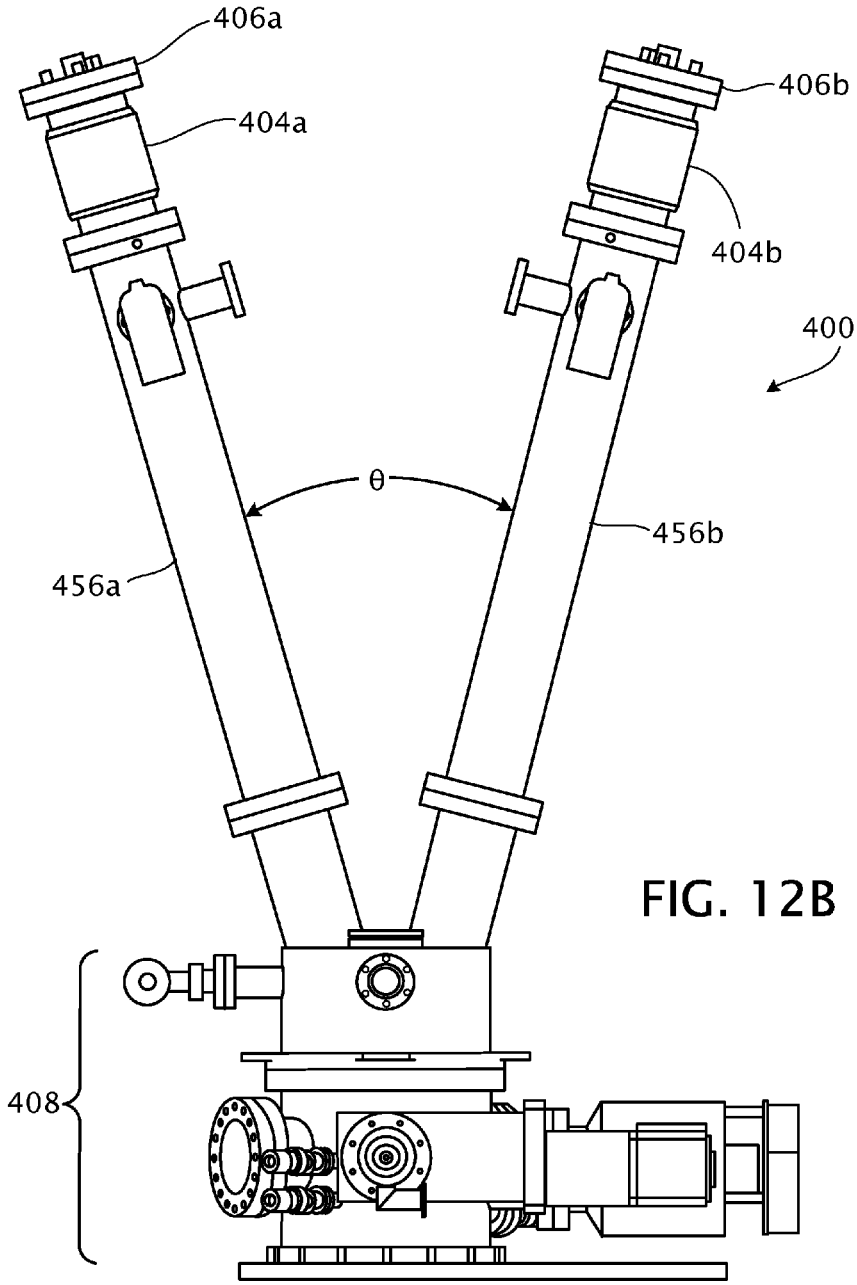
FIG. 12B is a side view of the ADTOF mass spectrometer.

FIG. 12B is a side view of the ADTOF mass spectrometer 400. In this example, negative ions 106 travel in the flight tube 402*a* and positive ions 110 travel in the flight tube 402*b*. The vacuum housings 456*a* and 456*b* are connected to isolation chambers 404*a* and 404*b* (collectively referenced as 404), respectively, which are connected to detectors 406*a* and 406*b*, respectively. The isolation chamber 404 can be made of ceramic and serves the purpose of isolating the high voltage of ion detectors from the system ground voltage. The detectors 406*a* and 406*b* detect the negative ions 106 and positive ions 110, respectively. The detectors can be, e.g., microchannel plates, charge detectors, current detectors, or secondary ion detectors, etc.

Figure 12C:
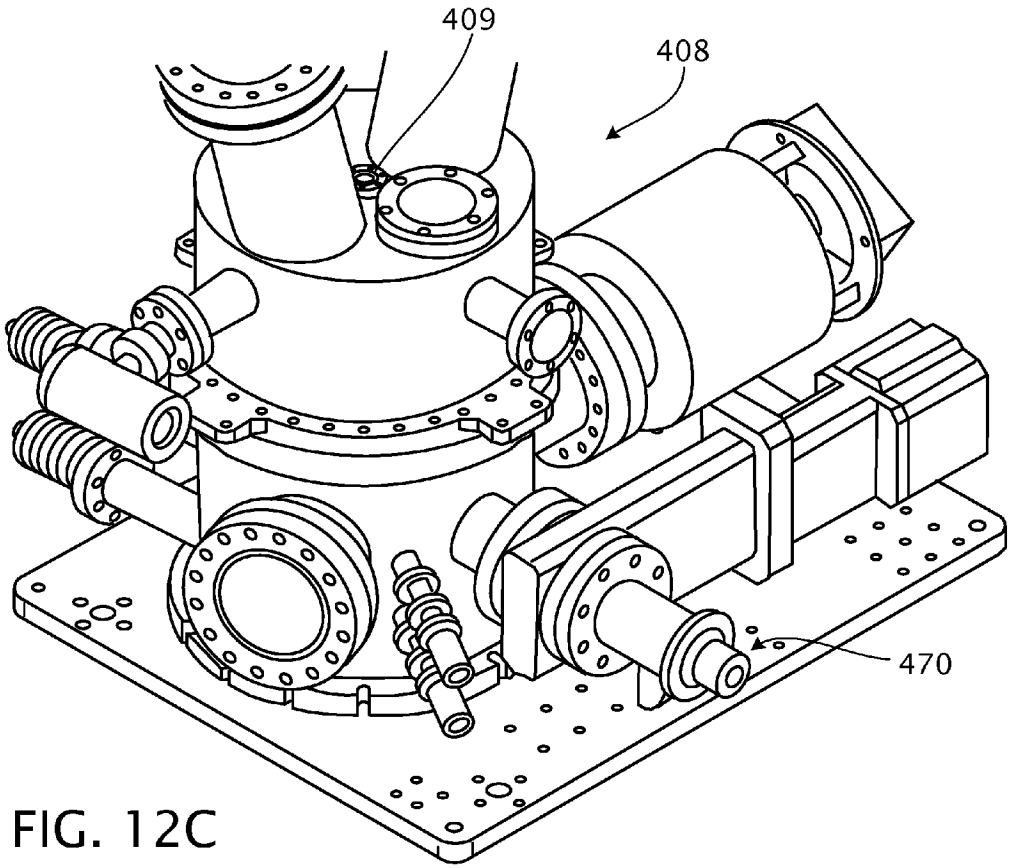
FIG. 12C is a diagram of a sample delivery system.

The ADTOF mass spectrometer 400 includes a sample delivery chamber 408 that accommodates the sample material and provides the positive and negative ions to the flight tubes 402 during experiments. FIG. 12C is a perspective view of sample delivery chamber 408. The sample material can be delivered into the center of the chamber 408 through an vacuum interface system 470. The laser beam or energetic particle beam can enter the sample delivery chamber 408 through a vacuum port 409. Additional vacuum ports are provided for electric wirings, sample imaging, and vacuum pumping. In some examples, a laser beam excites the sample from the surface, in which the laser beam travels along a path that is normal to the plane of the sample plate. The laser beam axis can be the principal axis of the ADTOF MS such that flight tubes 402*a* and 402*b* are installed symmetrically around the laser beam axis.

Figure 13:
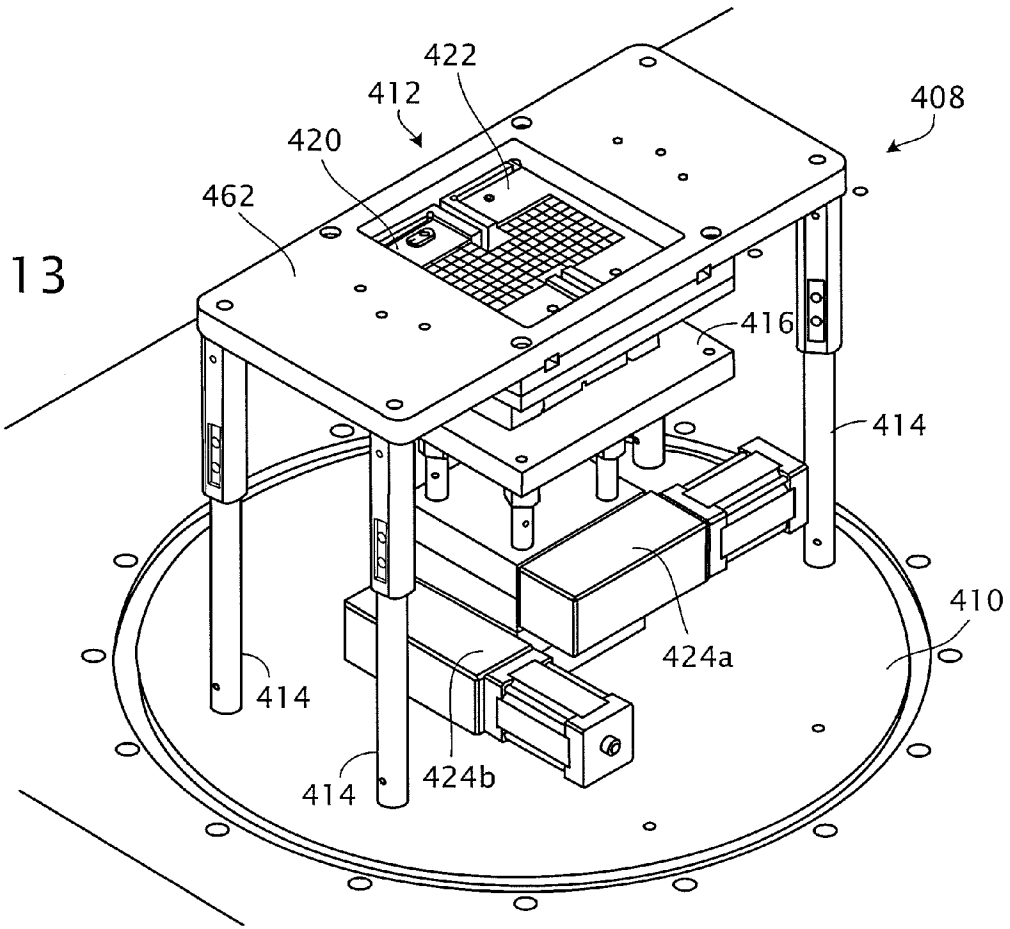
FIG. 13 is a diagram of a sample plate assembly.

Referring to FIG. 13, in some implementations, inside the sample delivery system 408, there is a base plate 410. The sample deliver system 408 includes a sample plate assembly 416 and an electrode assembly 412 for extracting ions from the sample plate assembly 416. The electrode assembly 412 is supported by posts 414 at a distance above the sample plate assembly 416. The electrode assembly 412 includes a support plate 462, negative ion electrodes 420, and positive ion electrodes 422. The sample plate assembly 416 can be adjusted in the X and Y directions using translational stages 424*a* and 424*b*, respectively.

The translational stages 424*a* and 424*b* can change the position of the sample plate assembly 416 relative to the electrode assembly 412. When the sample plate assembly 416 supports multiple sample materials, the mass spectrometer 400 can analyze one sample material at a time and analyze different samples at different periods of time. The sample plate assembly 416 can support, e.g., a slice of biological tissue. By controlling the translational stages 424*a* and 424*b* to change the position of the sample plate assembly 416 relative to the electrodes, the mass spectrometer 400 can analyze different regions of the slice of biological tissue, generating images of distributions of biomolecules (e.g., proteins, peptides) in biological tissue samples.

For example, the mass spectrometer 400 can generate an image having dots each indicating the abundance of a specific biological marker. This allows researchers to spatially determine, e.g., the expression of specific proteins in healthy versus diseased tissue. A slice of biological tissue can be logically divided into an array of small areas. With the laser beam position fixed, each small area of the tissue can be moved to where the laser beam is located, allowing the mass spectrometer 400 to examine and record the mass spectrum of ions excited by the laser beam in each small area. Note that the slice of biological tissue is not physically divided, rather, the sample plate assembly 416 is moved by the translational stages 424*a* and 424*b* to change the position of the slice relative to the laser beam so that the laser beam interrogates each small area in turn.

Figure 14:
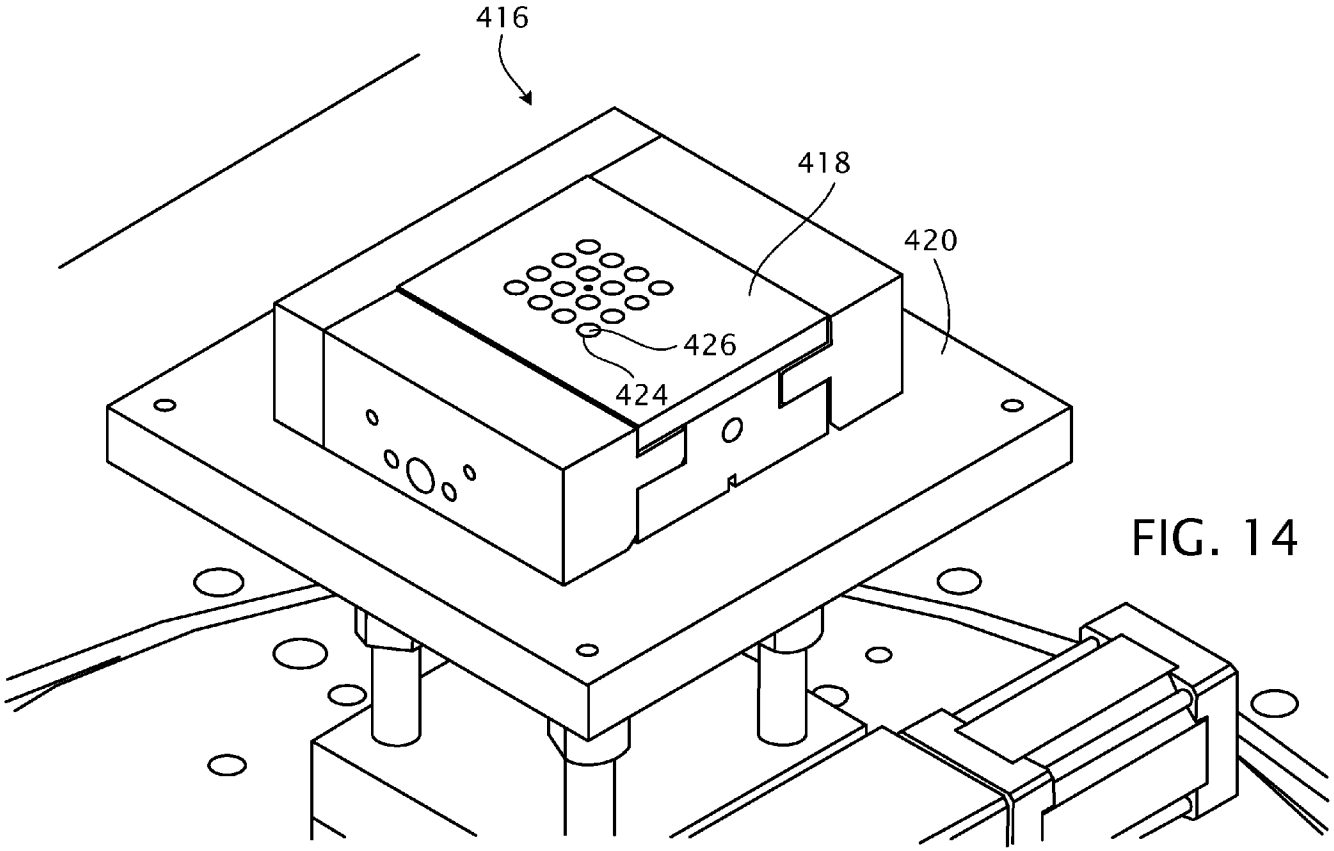
FIG. 14 is a diagram of extraction electrodes and acceleration electrodes.

Referring to FIG. 14, the sample plate assembly 416 includes a sample plate 418 mounted on a base plate 420. For example, the base plate 420 can be made of electrically insulating material, such as polyetheretherketone (PEEK). The sample plate 418 has an array (e.g., a 4-by-4 array) of sample areas 424. Sample materials 426 can be put in the sample areas 424. Liquid sample materials can be kept in the sample areas 424 by applying drops of the sample liquid and allow them to dry.

Figure 15:
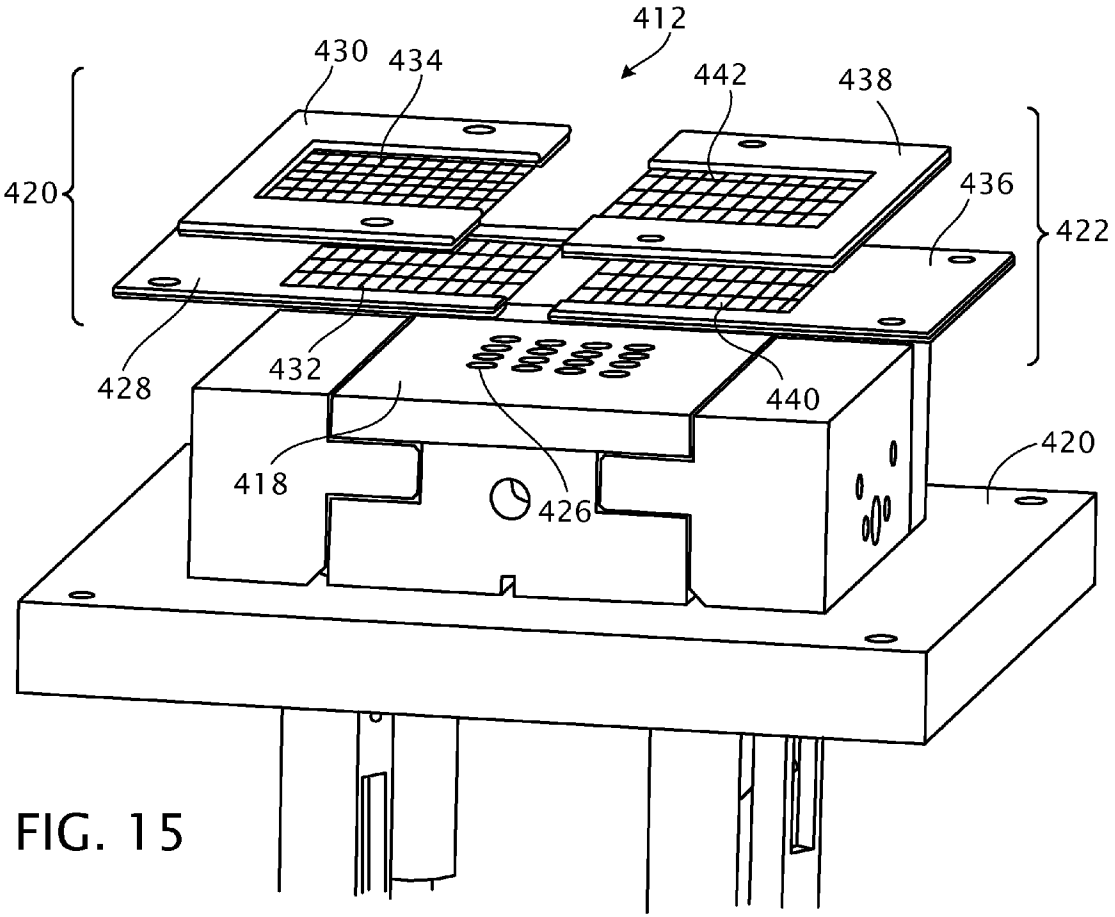
FIGS. 15 and 16 are diagrams of electrodes and ion trajectories.

Referring to FIG. 15, the negative electrodes 420 include a negative ion extraction electrode 428 and a negative ion acceleration electrode 430. The negative ion extraction electrode 428 includes a grid 432 having small openings to allow the negative ions 106 to pass. The negative ion acceleration electrode 430 includes a grid 434 having small openings to allow the negative ions 106 to pass. The positive electrodes 422 include a positive ion extraction electrode 436 and a positive ion acceleration electrode 438. The positive ion extraction electrode 436 includes a grid 440 having small openings to allow the positive ions 110 to pass. The positive ion acceleration electrode 438 includes a grid 442 having small openings to allow the positive ions 110 to pass. For example, the openings can have a size of about 0.26 by 0.26 mm, and the transmittance of the grids can be about 90%. In some implementations, the electrodes 428, 430, 436, and 438 are flat plates, the electrodes 428 and 430 are parallel to each other, and the electrodes 436 and 438 are parallel to each other. The electrodes can also have other configurations, such as non-planar shapes, and the electrode pairs 428 and 430 (or 436 and 438) do not necessarily have to be parallel to each other.

Figure 16:
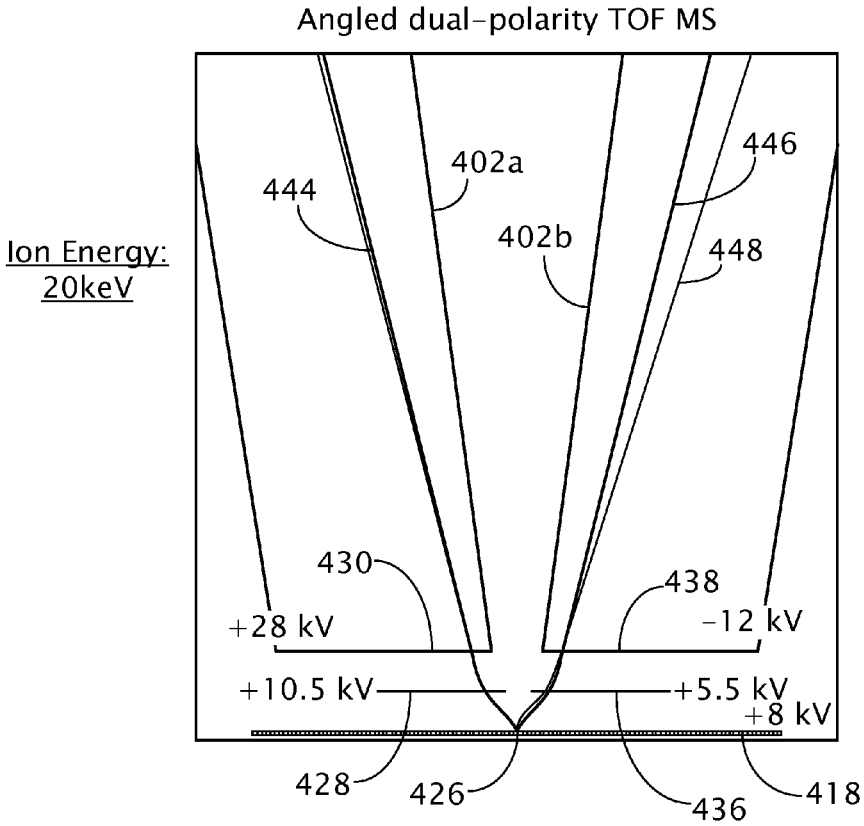

Referring to FIG. 16, negative ions and positive ions are attracted by the negative ion extraction electrode 428 and the positive ion extraction electrode 436, respectively. The negative and positive ions that are extracted from the sample 426 travel along or near paths 444 and 446, through flight tubes 402*a* and 402*b*, respectively. The ions extracted from the sample 426 may emit from the sample 426 at different angles and deviate slightly from the ions travel along the flight tubes 402. For example, the trajectory line 448 shows the travel path of positive ions that are emitted from the sample 426 in a different condition from the conditions of the positive ions that travel along path 446.

In some implementations, the negative ion acceleration electrode 430 has a voltage that is higher than that of the negative ion extraction electrode 428, which has a voltage higher than that of the sample plate 418. This causes negative ions to be extracted from the sample 426 and accelerated toward the flight tube 402*a*. The positive ion acceleration electrode 438 has a voltage that is lower than that of the voltage of the positive ion extraction electrode 436, which has a voltage that is lower than that of the sample plate 418. This causes positive ions to be extracted from the sample 426 and accelerated toward the flight tube 402*b*. The voltage difference (e.g., 17.5 kV) between the negative ion extraction electrode 428 and acceleration electrode 430 is the same as the voltage difference between the positive ion extraction electrode 436 and acceleration electrode 438. The voltage difference (e.g., 2.5 kV) between the negative ion extraction electrode 428 and sample plate 418 is the same as the voltage difference between the positive ion extraction electrode 436 and sample plate 418. The voltage difference (e.g., 17.5 kV) between the negative ion extraction electrode 428 and acceleration electrode 430 is greater than the voltage difference (e.g., 2.5 kV) between the negative ion extraction electrode 428 and the sample plate 418. The voltages of electrodes 428, 430, 436, and 438 may be adjusted independently to optimize the instrument performance.

In this example, the sample plate 418, negative ion extraction electrode 428, negative ion acceleration electrode 430, positive ion extraction electrode 436, and positive ion acceleration electrode 438 have voltages of 8 kV, 10.5 kV, 28 kV, 5.5 kV, and −12 kV, respectively, relative to ground. In this example, the flight tubes 402*a* and 402*b* can be electrically coupled to the electrodes 430 and 438, respectively. For example, the base plate 410 and vacuum housing 456*a*, 456*b* (see FIGS. 12A and 12B) of the mass spectrometer 400 can be connected to electric ground. The ions traveling in the flight tubes can have energy ranging from a few hundred electron volts to several million electron volts. The sample plate 418 and the electrodes can also have other voltage potentials.

The region between the sample plate 418 and the negative ion extraction electrode 428 can be a first trajectory adjustment stage, and the region between the negative ion extraction electrode 428 and the negative ion acceleration electrode 430 can be a first acceleration stage. The region between the sample plate 418 and the positive ion extraction electrode 436 can be a second trajectory adjustment stage, and the region between the positive ion extraction electrode 436 and the positive ion acceleration electrode 438 can be a second acceleration stage.

Figure 17:
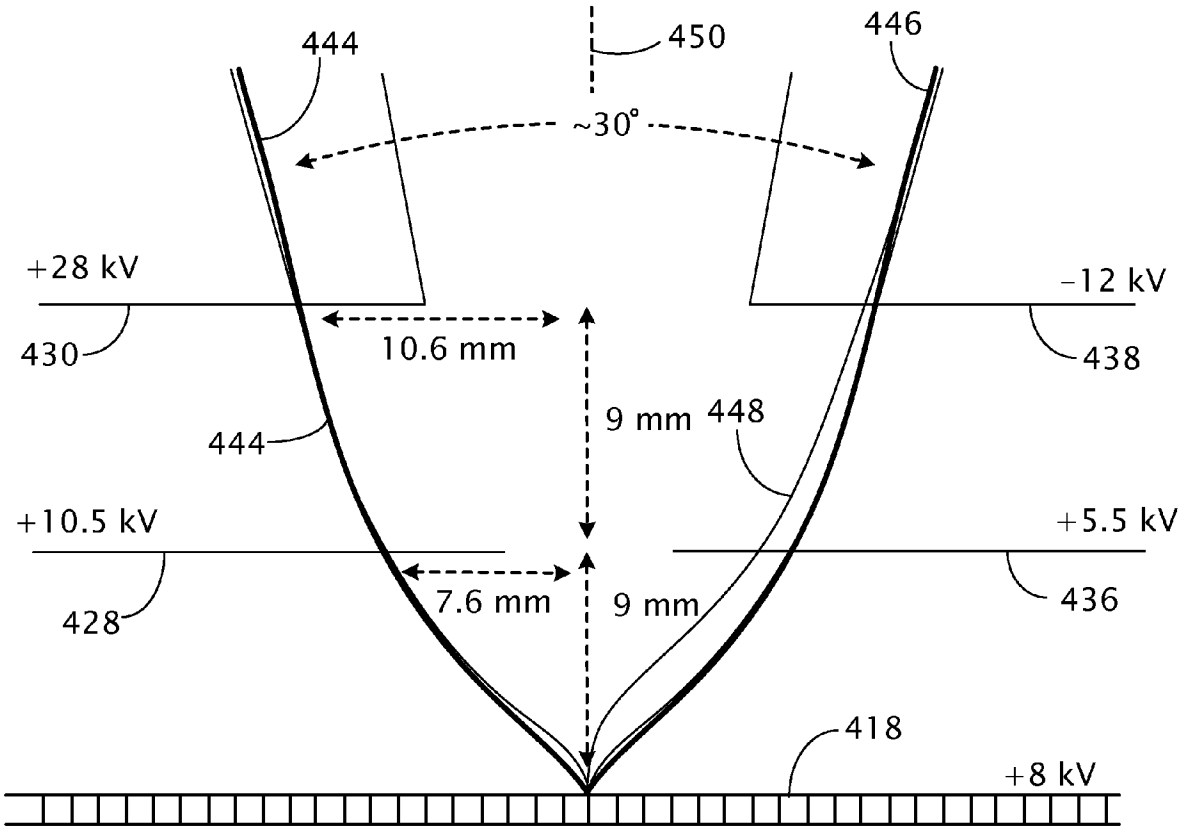
FIG. 17 shows a two-dimensional potential map of the mass spectrometer.

Referring to FIG. 17, in one example, the distance between the surface of the sample plate 418 and the negative ion extraction electrode 428 (or the positive ion extraction electrode 436) is approximately 9 mm, the distance between the negative ion extraction electrode 428 and the negative ion acceleration electrode 430 (or between the positive ion extraction electrode 436 and the positive ion acceleration electrode 438) is approximately 9 mm.

In some implementations, the electrodes 430 and 438, as well as the electrodes 428 and 436, are symmetrical with respect to a plane 450 (which is perpendicular to the plane of the figure). The axes of the flight tubes 402*a* and 402*b* lie on a plane P (which is parallel to the plane of the figure), and in some implementations the electrodes 430 and 438, as well as the electrodes 428 and 436, are also symmetrical with respect to the plane P. The sample to be analyzed can be positioned along an intersection of the plane 450 and plane P. For ions that are extracted from the sample 426, the negative ions travel along or near a path 444 in the drift region of the flight tube 402*a*, and the positive ions travel along or near a path 446 in the drift region of the flight tube 402*b*. The average paths 444 and 446 are at an angle in a range of about 0 to 179 degrees (in some examples, about 30 degrees) relative to each other. Note that the paths of individual negative or positive ions may be different from the average paths of the negative or positive ions, respectively.

Figure 18:
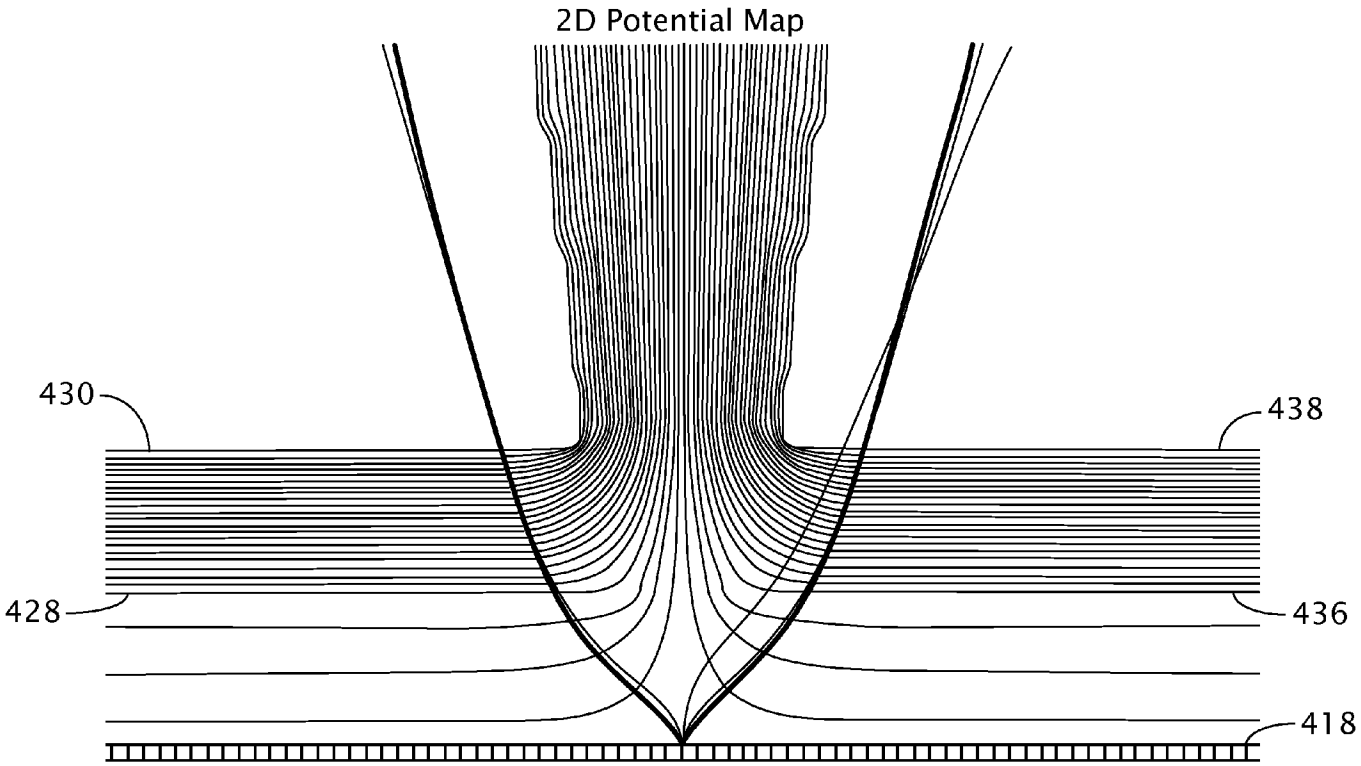
FIG. 18 is a diagram of an example ADTOF mass spectrometer.

FIG. 18 shows a two-dimensional (2D) potential map of the mass spectrometer 400 in the regions in the vicinity of the electrodes and the flight tubes. The negative ions 106 are extracted from the sample 426 due to the potential difference between the negative ion extraction electrode 428 and the sample plate 418. The electric field between the sample plate 418 and the negative ion extraction electrode 428 forms a first trajectory adjustment stage that adjusts the travel direction of the negative ions to be substantially aligned with the flight tube 402*a*. The electric field between the sample plate 418 and the positive ion extraction electrode 436 forms a second trajectory adjustment stage that adjusts the travel direction of the positive ions to be substantially aligned with the flight tube 402*b*.

After the negative ions pass the grid 432, the negative ions are accelerated toward the flight tube 402*a* due to the potential difference between the negative ion acceleration electrode 430 and the negative ion extraction electrode 428. Similarly, after the positive ions pass the grid 440, the positive ions are accelerated toward the flight tube 402*b* due to the potential difference between the positive ion acceleration electrode 438 and the positive ion extraction electrode 436.

In some implementations, the potential inside the flight tube 402*a* is maintained substantially the same as that of the negative ion acceleration electrode 430, and the potential inside the flight tube 402*b* is maintained substantially the same as that of the positive ion acceleration electrode 438. This way, the ions are not accelerated inside the flight tubes 402, and the amount of time that an ion travels the length of the flight tube 402 will be proportional to the ion's kinetic energy. The region inside the flights tubes 402 where the ions are not accelerated are field-free drift regions.

Some neutral particles can travel upward and can be post-ionized by a second laser or another energetic particle beam. The post-ionized molecules can either be analyzed by mass spectrometers 452 and 454, or by another mass analyzer installed in the space between the mass spectrometers 452 and 454.

Figure 19:
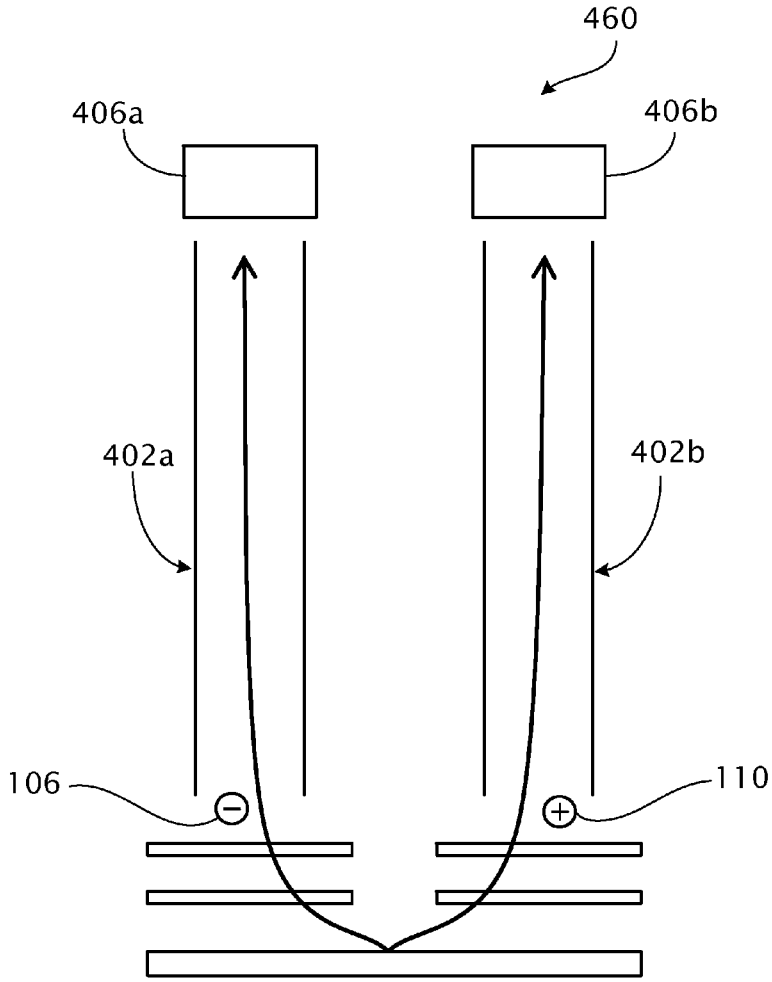
FIG. 19 is a diagram of an example of ADTOF mass spectrometer with the two flight tubes parallel to each other.

FIG. 19 is a diagram of an example mass spectrometer 460 that includes flight tubes 402*a* and 402*b* that are parallel to each other. Negative ions 106 travel in the flight tube 402*a* and are detected by a detector 406*a*. Positive ions 110 travel in the flight tube 402*b* and are detected by a detector 406*b*. The operation principles of the mass spectrometer 460 are similar to those of the spectrometer 400 of FIG. 18.

ALTERNATIVE EXAMPLES

Instead of using time-of-flight mass analyzers, each of the mass analyzers 104, 108, 272, 452 and 454 can use, e.g., a quadrupole mass analyzer, an ion trap mass analyzer, a magnet sector mass analyzer, a Fourier-transform ion-cyclotron-resonance mass spectrometer, or a momentum analyzer. The dimensions of the various components of the mass spectrometers 100 and 400 are not limited to those described above. The type of laser source 114 can be different from what is described above. Instead of using microchannel plates, each of the detectors 120, 122, 406*a* and 406*b* can include, e.g., a scintillation detector, an electron multiplier, an image current detector, or an electric current detector. The angle between the axes of the negative and positive mass analyzers 452 and 454 can be any value between 0 to 179 degrees, such as from about 20 to 140 degrees, or in some examples, from about 40 to 100 degrees. The suitable angle between the axes of mass analyzers 452 and 454 depends on the voltages of the electrodes, the distances between the electrodes, and the initial kinetic energies of the negative ions 106 and positive ions 110. In some implementations, increasing the voltage of negative ion extraction electrode 428 from 10.5 kV to 12 kV and decreasing the voltage of positive ion extraction electrode 436 from 5.5 kV to 4 kV may cause the best angle between negative and positive mass analyzers 452 and 454 to become about 35 degrees. In other implementations, a larger distance between the sample plate 418 and extraction electrodes 428 and 436 may cause the best angle between negative and positive mass analyzers 452 and 454 to decrease.

In FIG. 2, the sample to be analyzed does not necessarily have to be mixed in a matrix. For example, laser ablation (in which the sample molecules are excited directly by a laser without use of matrix molecules), focused electron-beam ionization, fast atom bombardment, can be used to generate the positive and negative ions. Instead of using a laser 114 to energize the sample material 146, the sample material 146 can be energized by using, e.g., electron beams, ion beams, or fast atom beams that include energized charged particles. The charged particles can be generated by electric current or laser and focused by an electric field. The fast atom beam can be generated by supersonic expansion.

Also, instead of using a MALDI source as in FIG. 2, for example, a surface-enhanced laser desorption ionization (SELDI) ion source, an electrospray ionization (ESI) ion source, an electron impact (EI) ion source, a secondary ion source, or a chemical ionization (CI) ion source can also be used. For ESI, EI, and CI ion sources, the sample probe of the sample electrode 130 can be modified to become a hollow tube, or the probe can be removed to leave the tunnel empty. The ions of these ion sources (ESI, EI, and CI) are generated outside of the sample electrode 130 and guided along the hollow tube (or tunnel) of the sample electrode 130. Once the ions exit through the end of the hollow tube (or tunnel), the ions are guided and directed toward the rectangular slots 154*a* and 154*b*, and accelerated toward the flight tubes 118 and 116, respectively.

The voltages applied to the ion source electrode 130 and the extraction electrodes 126*a*, 126*b*, 128*a*, and 128*b* can be different from those described above. In FIG. 4, the voltage applied to the extraction electrode 128*b* does not necessarily have to be higher than the voltage applied to the extraction electrode 128*a*. Similarly, the voltage applied to the extraction electrode 126*b* does not necessarily have to be lower than the voltage applied to the extraction electrode 126*a*.

In FIG. 15, the voltages applied to the electrodes 428, 430, 436, and 438 can be different from those described above. The flight tube 402*a* can have a voltage that is different from that of the electrode 430, and the flight tube 402*b* can have a voltage that is different from that of the electrode 438. The electrode assembly 412 can have additional electrodes to finely adjust the ion trajectory or to guide the ions toward the spectrometers 452 and 454 efficiently. For example, the electrode assembly 412 can have sets of electrodes that form a plurality of ion trajectory adjustment stages to adjust the positive ion trajectory and the negative ion trajectory.

Different configurations of the ion source electrodes 130 may be used for different types of ion sources. For each type of ion source, the geometry and dimensions of the ion source electrode 130, as well as the voltage(s) applied to the ion source electrode 130 are adjusted so as to generate an electric field distribution that directs the positive and negative ions 110 and 106 toward the positive and negative ion mass spectrometers, respectively, before the ions enter the acceleration regions. The positive and negative ions do not necessarily have to travel in a direction parallel to the x-axis when entering the acceleration regions, and can be tilted at a slight angle with respect to the x-axis.

The geometry of the ion source electrode 130 and the extraction electrodes 126*a*, 126*b*, 128*a*, and 128*b* can be different from those described above. In FIG. 6, the different components of the electrode 130 do not necessarily have to be at the same electric potential as long as the electric field distribution causes the positive ions to be focused and guided through the rectangular slot 154*a* and the negative ions to be focused and guided through the rectangular slot 154*b*.

The positive and negative ion mass spectrometers can further include reflectrons to improve the mass spectral qualities. A reflectron, also known as an ion minor, is a type of time-of-flight mass spectrometer that uses a static electric field to reverse the direction of travel of the ions entering it.

It is to be understood that the foregoing description is intended to illustrate and not to limit the scope of the invention, which is defined by the scope of the appended claims. Other embodiments are within the scope of the following claims.

What is claimed is:

1. An angled dual-polarity mass spectrometer comprising:

a dual-polarity ion generator comprising an ion source to generate positive ions and negative ions from a sample, and electrodes to generate electric fields for guiding the negative ions into a beam of negative ions and guiding the positive ions into a beam of positive ions;

a first mass analyzer to analyze the negative ions;

a second mass analyzer to analyze the positive ions, the central axes of the first and the second mass analyzers being at an angle between 0 to 179 degrees;

wherein the electrodes comprise at least a negative ion extraction electrode and a positive ion extraction electrode, the negative ion extraction electrode being positioned between the ion source and the first mass analyzer, the positive ion extraction electrode being positioned between the ion source and the second mass analyzer, the negative ion extraction electrode having a voltage that is higher than that of a sample plate on which the sample is placed, the positive ion extraction electrode having a voltage that is lower than that of the sample plate.

2. The mass spectrometer of claim 1 in which the first mass analyzer comprises:

a first flight tube to receive the beam of negative ions, and a first ion detector to detect negative ions that travel in the first flight tube;

and the second mass analyzer comprises:

a second flight tube to receive the beam of positive ions, the second flight tube being at an angle between 0 to 179 degrees relative to the first flight tube, and a second ion detector to detect positive ions that travel in the second flight tube.

3. The mass spectrometer of claim 2 in which an axis of the second flight tube is at an angle between 0 to 179 degrees relative to an axis of the first flight tube.

4. The mass spectrometer of claim 2 in which an axis of the second flight tube is at an angle from 20 to 60 degrees relative to an axis of the first flight tube.

5. The mass spectrometer of claim 2 in which the first ion detector comprises at least one of a scintillation detector, a microchannel plate detector, an electron multiplier, or an electric current detector.

6. The mass spectrometer of claim 1 in which the electrodes comprise a negative ion acceleration electrode and a positive ion acceleration electrode, the negative ion acceleration electrode having a voltage that is higher than that of the sample plate, the positive ion acceleration electrode having a voltage that is lower than that of the sample plate.

7. The mass spectrometer of claim 6 in which each of the negative and positive ion acceleration electrodes comprises a grid having openings to allow ions to pass.

8. The mass spectrometer of claim 1 in which each of the negative and positive ion acceleration electrodes comprises a grid having openings to allow ions to pass.

9. The mass spectrometer of claim 1 in which the electrodes are configured to generate an electric field that causes the beam of negative ions to travel, on average, along a first central axis of the first mass analyzer and the beam of positive ions to travel, on average, along a second central axis of the second mass analyzer, the second average axis being at an angle in a range of 0 to 179 degrees relative to the first central axis.

10. The mass spectrometer of claim 9 in which the second axis is at an angle in a range between 20 to 60 degrees relative to the first axis.

11. The mass spectrometer of claim 1, comprising:

a sample plate to support a plurality of samples, and one or more translational stages to change the position of the sample plate relative to the electrodes to allow the mass spectrometer to analyze each of the different samples.

12. The mass spectrometer of claim 1, comprising:

a sample plate to support the sample, and at least one translational stage to change the position of the sample plate relative to the electrodes to allow the mass spectrometer to analyze each of different portions of the sample.

13. The mass spectrometer of claim 12, comprising a signal acquisition and instrument control device to control positioning of the sample plate, analyses of mass spectra of the various regions of the sample; and recording of data representing the mass spectra.

14. The mass spectrometer of claim 1 in which the electrodes are symmetrical with respect to a plane that passes the sample.

15. The mass-speetrometer of claim 1 in which the ion source comprises at least one of a matrix-assisted laser desorption/ionization (MALDI) ion source, a surface-enhanced laser desorption ionization (SELDI) ion source, a laser ablation ion source, an electrospray ionization (ESI) ion-source, an electron impact (EI) ion source, a secondary ion source, a fast atom bombardment (FAB) ion source, a laser-desorption post ionization source, or a chemical ionization (CI) ion source.

16. The mass spectrometer of claim 1, in which electrodes comprise sets of electrodes to form a plurality of ion trajectory adjustment stages to adjust the positive ion trajectory and negative ion trajectory.

17. The mass spectrometer of claim 1 in which each of the negative and positive ion extraction electrodes comprises a grid having openings to allow ions to pass.

18. The mass spectrometer of claim 6 in which each of the negative and positive ion extraction electrodes comprises a grid having openings to allow ions to pass.

19. The apparatus of claim 18 in which the second average path is at an angle in a range between 20 to 60 degrees relative to the first average path.

20. A method of analyzing mass spectrum, the method comprising:

generating an electric field using electrodes;

generating positive and negative ions from a sample positioned in the electric field;

guiding, using a first portion of the electric field, the negative ions along a first path toward a first mass analyzer that extends along a first axis;

guiding, using a second portion of the electric field, the positive ions along a second path toward a second mass analyzer that extends along a second axis, and the second axis is at an angle in a range between 0 to 179 degrees relative to the first axis;

analyzing the negative ions using the first mass analyzer; and analyzing the positive ions using the second mass analyzer;

wherein the electrodes comprise at least a negative ion extraction electrode and a positive ion extraction electrode, the negative ion extraction electrode being positioned between the sample and the first mass analyzer, the positive ion extraction electrode being positioned between the sample and the second mass analyzer.

21. The method of claim 20 in which guiding the negative ions comprises passing the negative ions through openings in a grid of the negative ion extraction electrode having a voltage higher than that of a sample plate that holds the sample, and guiding the positive ions comprises passing the positive ions through openings in a grid of the positive ion extraction electrode having a voltage lower than the sample plate.

22. The method of claim 21 in which guiding the negative ions comprises passing the negative ions through openings in a grid of a negative ion acceleration electrode having a voltage higher than that of the negative ion extraction electrode, and guiding the positive ions comprises passing the positive ions through openings in a grid of a positive ion acceleration electrode having a voltage lower than that of the positive ion extraction electrode.

23. The method of claim 20, comprising moving a sample plate supporting a plurality of samples and analyzing the mass spectrum of each of the different samples.

24. The method of claim 20, comprising moving a sample plate supporting the sample and analyzing the mass spectrum of each of different regions of the sample.

* * * * *